United States Patent [19]

Bunger

[11] 4,056,996

[45] * Nov. 8, 1977

[54] ELECTRONIC MUSIC SYSTEM

[75] Inventor: David A. Bunger, Cincinnati, Ohio

[73] Assignee: D. H. Baldwin Company, Cincinnati, Ohio

[ * ] Notice: The portion of the term of this patent subsequent to Apr. 2, 1991, has been disclaimed.

[21] Appl. No.: 589,559

[22] Filed: June 23, 1975

Related U.S. Application Data

[60] Continuation of Ser. No. 452,045, March 18, 1974, abandoned, which is a division of Ser. No. 263,649, June 16, 1972, Pat. No. 3,801,721, which is a continuation-in-part of Ser. No. 213,939, Dec. 30, 1971, Pat. No. 3,789,718.

[51] Int. Cl.[2] ..... G10H 1/02; G10H 5/10

[52] U.S. Cl. ..... 84/1.19; 84/1.24; 84/1.25; 84/1.26; 84/DIG. 2; 84/DIG. 9; 84/DIG. 20; 332/9 R

[58] Field of Search ..... 84/1.01, 1.03, 1.11–1.13, 84/1.17, 1.19–1.26, DIG. 2, DIG. 4, DIG. 9, DIG. 20; 332/9 R, 16 R

[56] References Cited

U.S. PATENT DOCUMENTS

| | | | |
|---|---|---|---|
| Re. 27,983 | 4/1974 | Stearns | 84/1.01 |
| 3,288,904 | 11/1966 | George | 84/1.01 |
| 3,288,907 | 11/1966 | George | 84/1.25 |
| 3,519,720 | 7/1970 | Bunger | 84/1.12 |
| 3,530,225 | 9/1970 | Gschwandtner | 84/1.13 |
| 3,538,804 | 11/1970 | George | 84/1.01 |
| 3,568,094 | 3/1971 | Metzger | 332/9 R |
| 3,668,559 | 6/1972 | Williams et al. | 332/9 R |
| 3,711,620 | 1/1973 | Kameoka et al. | 84/1.24 |
| 3,767,834 | 10/1973 | Hebeisen et al. | 84/1.19 |
| 3,801,721 | 4/1974 | Bunger | 84/1.19 |
| 3,821,461 | 6/1974 | Mieda | 84/1.19 |

*Primary Examiner*—Stanley J. Witkowski
*Attorney, Agent, or Firm*—Kirkland & Ellis

[57] ABSTRACT

A monophonic system includes means for voicing only tones derived in response to depression of a key associated with the highest pitched note when several keys are struck at approximately the same time, regardless of the order in which the keys are struck. If several keys are released at approximately the same time, only the tones derived in response to the highest remaining activated key are voiced, regardless of the release sequence. In response to the system being played legatissimo, voiced tones gradually shift in frequency, i.e., portamento is achieved. In response to the system being played staccatissimo, voiced tones shift in frequency in discrete steps. For unusual or special effect tone simulation, square wave tone signals derived from a frequency divider chain responsive to a voltage controlled oscillator, controlled primarily by the nomenclature of the highest pitch struck key, may be converted into a sawtooth waveform, a pulse waveform having a pulse width controlled by the highest pitch struck key, or can be left unaltered. Clicks and noise can be derived in response to key activations. The sawtooth, pulse, square wave, clicks and noise are fed through a filter selectively having band pass, low pass and high pass transfer characteristics that can be controlled with regard to resonant frequency and selectivity (Q) to provide additional unusual effects. A first group of tone signals derived from the frequency divider is processed to simulate flutes while a second group is processed to simulate brasses. In flute simulation, filtering of harmonics and passage to an output of the fundamental of the tone associated with the highest pitch struck key is assured by including in cascade a low pass filter and an amplifier having a variable gain characteristic directly related to the nomenclature of the highest pitch struck key. In brass simulation, an attack envelope having plural slopes is provided. Brass brightness is controlled by providing a variable wave shaper that responds to pedal control or is a transient function during the attack of the voice. Flatting during the attack of a brass tone is simulated by transiently reducing the voltage controlled oscillator frequency when a new highest pitch key is struck by an amount indicative of the nomenclature of the struck key. Attack rates of the flutes and unusual tones can be controlled to a plurality of values; if the system is in a percussive mode the attack rate is relatively fast. Roll-off rate of certain flute tones is fixed, while other flute tones and the unusual tones can be provided with a fixed roll-off or sustain effect. The voltage controlled oscillator frequency is modulated by a vibrato oscillator frequency, the frequency of which can be fixed or controlled in a random manner in response to a noise source to simulate brass vibrato effects.

25 Claims, 14 Drawing Figures

FIG. 8
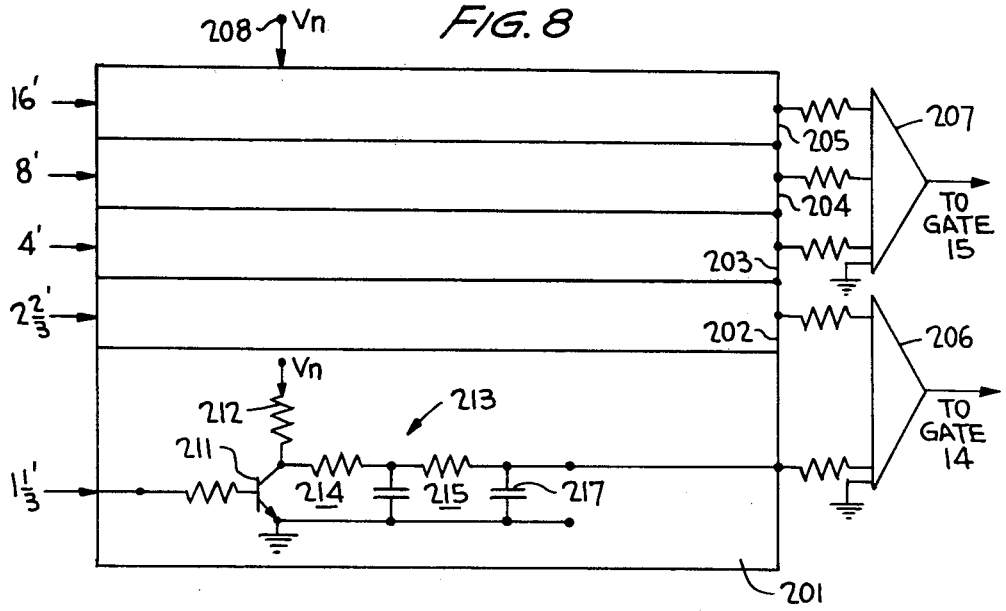
FIG. 12A
FIG. 12B
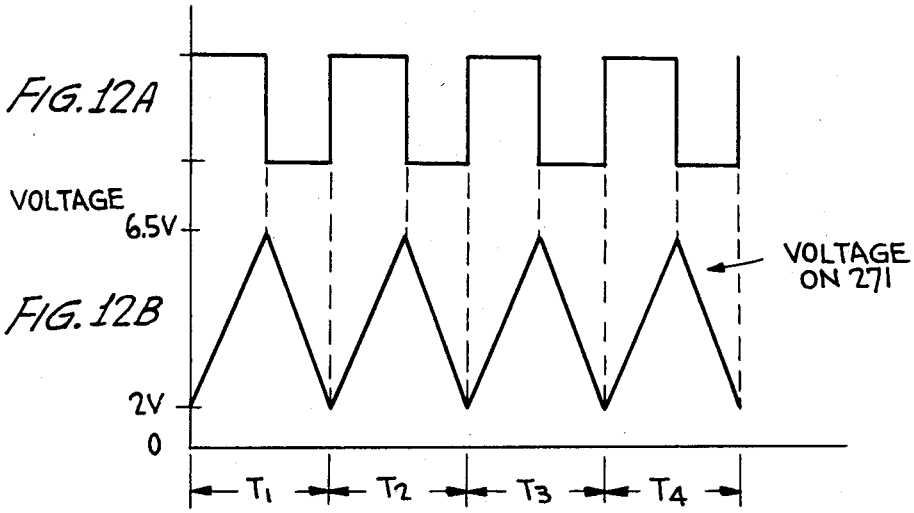
FIG. 13
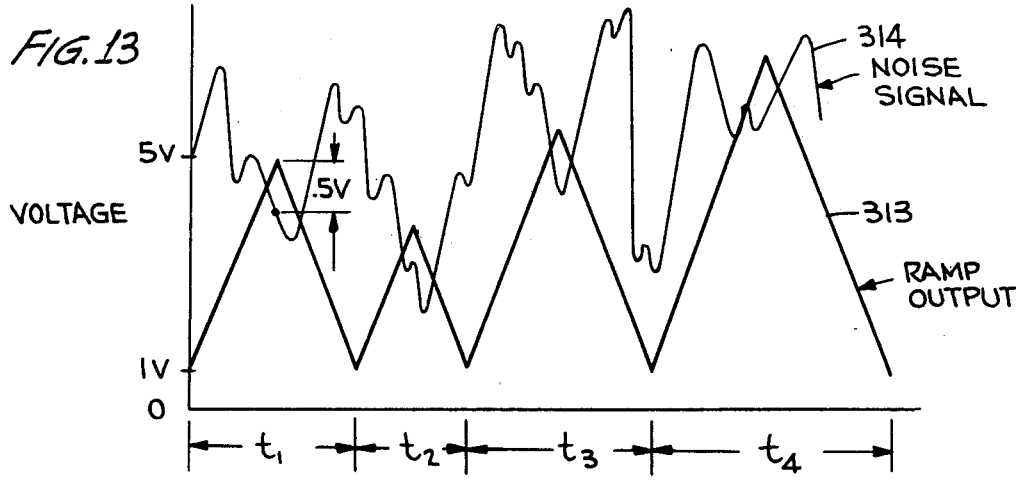

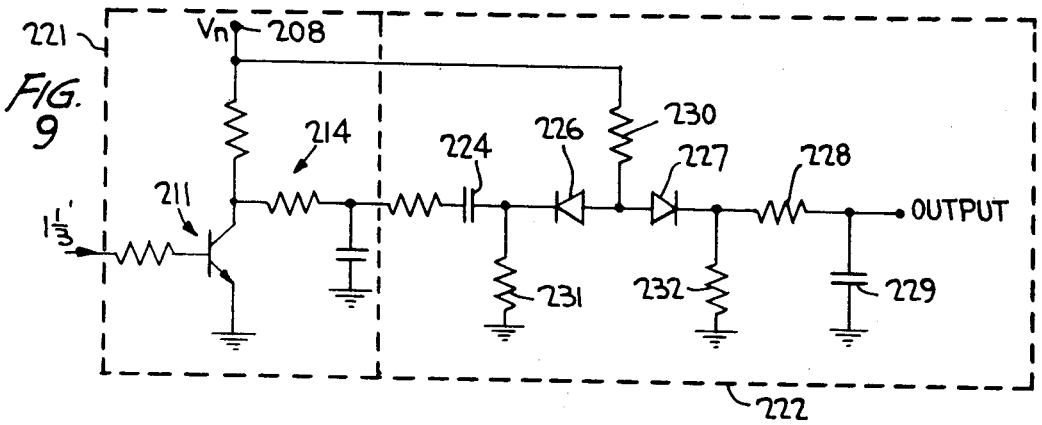
FIG. 10
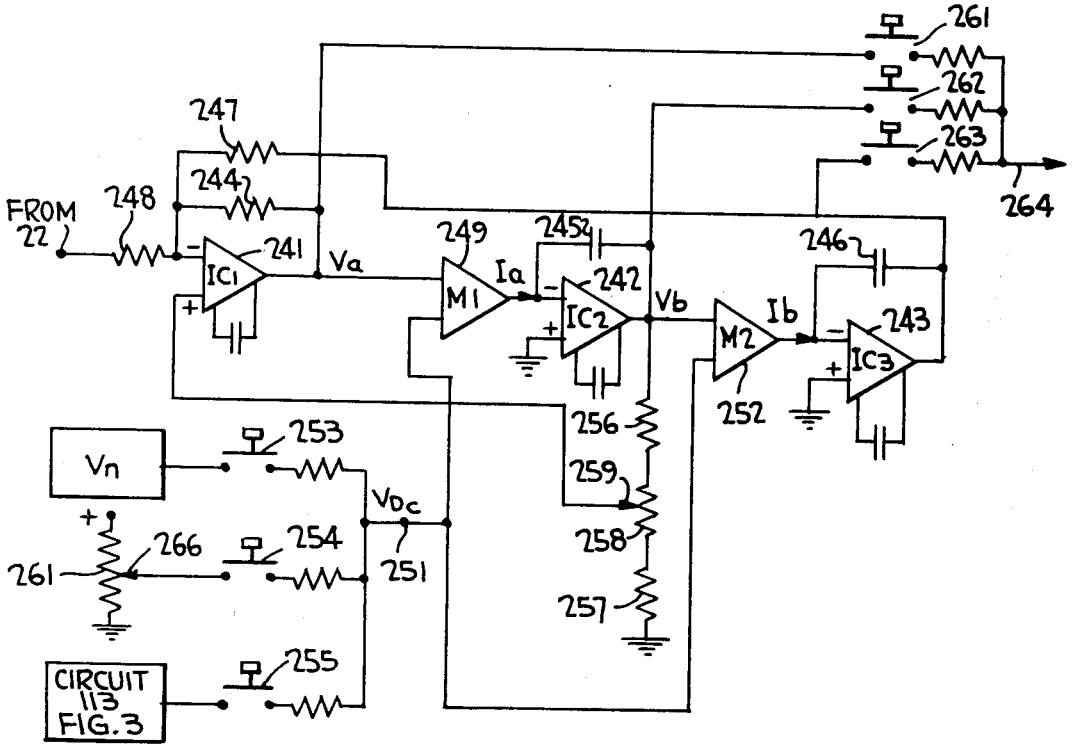

ELECTRONIC MUSIC SYSTEM

RELATIONSHIP TO COPENDING APPLICATIONS

This application is a continuation of application Ser. No. 452,045, filed Mar. 18, 1974, and now abandoned; which is a division of application Ser. No. 263,649, filed June 16, 1972, and now U.S. Pat. No. 3,801,721, which is a continuation-in-part of application Ser. No. 213,939, filed Dec. 30, 1971, and now U.S. Pat. No. 3,789,718.

BACKGROUND AND BRIEF DESCRIPTION OF THE INVENTION

As an accompaniment to conventional electronic organs, tone synthesizers responsive to a signal indicative of a nomenclature (i.e., note) associated with a highest pitch struck key on an organ keyboard have been developed. Synthesized tones are derived that are chordally and octavally related to the tone of the highest pitch struck key. Most prior art synthesizers require the musician always to depress the highest pitch key of a note grouping or chord first and release the highest pitch key last. If this technique, which many musicians find difficult to perform, is not followed, the melody effect is voiced on the note which is first depressed and jumps to the second depressed note, until the highest note of the chord has been struck. The resulting continuous jumping from note to note until the highest note of the chord is struck occurs because of the musician's inability, no matter how skilled, to depress consistently all of the keys of a chord at precisely the same time or to cause the highest pitch key of the chord to be depressed first. A similar effect occurs in reverse in response to the musician attempting, but failing, to release all of the keys simultaneously.

Systems which partially remove the keying accuracy requirement of the musician are disclosed in U.S. Pat. Nos. 3,288,904 and 3,538,804. The patented systems employ a high note guard arrangement to prevent a change in frequency of voiced sounds in the event the highest pitch struck key of a played chord is released by the musician until a new chord or highest pitch struck key of a played chord is released by the musician or a new chord or highest pitch struck key is subsequently played. The prior arrangement prevents tones associated with the highest pitch struck key from decreasing in frequency in response to release of the highest pitch struck key, a desirable feature only when the musician intends to release all of the keys approximately simultaneously. If the musician modifies the played chord to form a new chord wherein the highest depressed key is of lower tone than the previously highest depressed key, to provide a melody effect, the high note guard requires the musician to release and then depress the key which has now become the highest pitch key of the new chord. Otherwise, the melody effect of the synthesizer does not enhance the tones accompanying the new, lower pitch, highest pitch struck key. Hence, the prior art system requires the musician to develop a specific, unnatural technique for shifting from one key combination to another. Further, if the musician has released all of the depressed keys and then attempts to play another key combination, the high note guard circuit of the prior art does not eliminate the requirement for the musician to depress the highest tone key of the chord before striking any of the other keys.

In studies made in connection with development of the present invention it was discovered that the vast majority of musicians are able to depress all of the keys of a key grouping within 20 milliseconds or less and to shift from one key grouping to a second key grouping, which includes keys of the first key grouping, within 60 milliseconds. Advantage is taken of this discovery by delaying voicing of any tones associated with a new key grouping for a predetermined time period, 20 milliseconds or less. In shifting from one key grouping to a second key grouping, which includes keys of the first key grouping, coupling of tones associated with the highest struck key of the second key grouping are not voiced until approximately 60 milliseconds has elapsed from the first release of a key of the first key grouping. By delaying voicing of tones associated with the highest struck key of a grouping, the musician is not required to strike and release the keys in an unnatural manner and voicing of tones associated with keys other than the highest pitch key of a key grouping is precluded.

In accordance with a further feature of the invention, portamento is provided in response to the musician striking the keys legatissimo. Thereby, in response to a subsequent key grouping being struck while another previously struck key grouping is being voiced, wherein the subsequent key grouping has a higher pitch key than the previous key grouping, tones are smoothly shifted from frequencies associated with the highest pitch key of the previous grouping to the highest pitch key of the subsequent grouping. If the keys are activated staccatissimo, the change in frequency from one key grouping to another key grouping is in discrete steps.

In accordance with a further feature of the invention, unusual or special tones are synthesized in response to tones derived in response to the highest pitch struck key of a key grouping or in response to each change in the highest pitch struck key or noise. In response to the derived tones, tone signals having different harmonic content, represented as square waves, triangular waves and pulses are derived. The pulse widths are controlled by the highest pitch struck key within a grouping. These synthesized tones provide organs of the present invention with a wide variety of sounds and effects heretofore not previously presented on commercially available electronic organs. The unusual effects are further modified by one of or a combination of low pass, high pass, or band pass filters, having cutoff or center frequencies controlled in response to one of several parameters, and sharpness controlled by the musician.

As another feature of the invention, accurate brass tone simulation is provided. In studies made in conjunction with development of the present invention, it has been determined that there are seven major important characteristics for accurate simulation of brass tones. These characteristics are: attack rate, attack transient frequency, controlled portamento, vibrato, attack tone color change, tone color change as a function of the dynamic level of the voiced tone, and overall tone quality. It has been found that attack rate is typically composed of a pair of exponentially related, sequentially derived envelopes as the tone is being initially voiced. The effect is achieved with the present instrument by amplitude modulating tones derived in response to the highest note voices being initially sounded. It has also been found that brass tones, when initially voiced, have a tendency to be transiently flat. The flatting effect is simulated with the present invention by reducing, on a transient basis, the frequency of tones derived in response to initial striking of the highest pitch key. The amount of frequency reduction is dependent upon the highest note depressed to provide accurate simulation of initial brass voicing. It has also been found that tones derived from a brass instrument have a tendency to be frequency modulated in a random fashion at a sub-audio, vibrato rate. To this end, brass tones being voiced are frequency modulated at a sub-audio rate that varies in a random manner about a center frequency. It has also been found that during the attack phase of a brass instrument, tone color is brighter as time progresses. To this end, a variable wave shaping circuit increases the harmonic content of the voice as time progresses, for the simulated brass tones. Also, brass tone color brightness is increased as dynamic level increases, an effect attained by increasing the harmonic content of the voice with another wave shaping circuit as tone level increases.

According to a further feature of the invention, there is provided a new and improved network for simulating the characteristics of flutes. Previously, it was the general practice to simulate flutes with fixed filters or complex, expensive filters having cutoff frequencies varied in response to the input frequency thereof. In accordance with this feature of the invention, a simple, inexpensive flute filter is provided for passing the fundamental of the highest pitch key, and for rejecting harmonics, regardless of the fundamental frequency of the highest pitch struck key and of the harmonics thereof. Such result is attained by cascading a fixed, low pass filter with a variable gain amplifier, the gain of which is controlled as a direct and linear function of the nomenclature of the highest pitch struck key. Control of the gain of the amplifier is achieved in a relatively simple manner since the frequency of generated tones is controlled in response to a voltage linearly related to the highest pitch struck key, said voltage is supplied as a gain control to the amplifier.

In accordance with another feature of the invention, the attack rate of flute tones and the unusual tones may be controlled, upon the will of the musician, depending upon a selected operating mode. In a so called continuous mode, the attack rate for the flutes and unusual tones can be either relatively fast or slow. In a percussive mode, wherein tones are derived for only a predetermined time after activation of a key grouping regardless of whether the key grouping remains struck, the attack rate is always relatively fast. In both modes, the roll-off rate of certain of the flute tones, subsequent to release of the keys, is fixed. For other flute tones and the special tones, a sustain effect is provided with the organ in the percussive mode and can be provided at the will of the musician in the continuous mode.

A common aspect of many of the features is control of tone frequency and content in response to a voltage indicative of the nomenclature of the highest pitch struck key. The voltage, in addition to controlling the tone frequency of a voltage controlled oscillator (as in my copending application), provides tone content control in a simple and inexpensive manner with regard to: flatting extent, tone pulse width, flute filter amplifier gain, and, in certain instances, resonant frequency of a voltage controlled filter selectively having low pass, high pass and band pass characteristics responsive to the unusual tone sources.

BRIEF DESCRIPTION OF THE DRAWING

FIG. 8 is a partial block, partial circuit diagram of the flute filters used in FIG. 1;

FIG. 9 is a modification of one filter of FIG. 8;

FIG. 10 is a circuit diagram of a voltage controlled filter used in FIG. 1;

FIGS. 12*a*, 12*b* and 13 are waveforms to assist in describing the oscillator of FIG. 11.

DETAILED DESCRIPTION OF THE DRAWING

Figure 1:
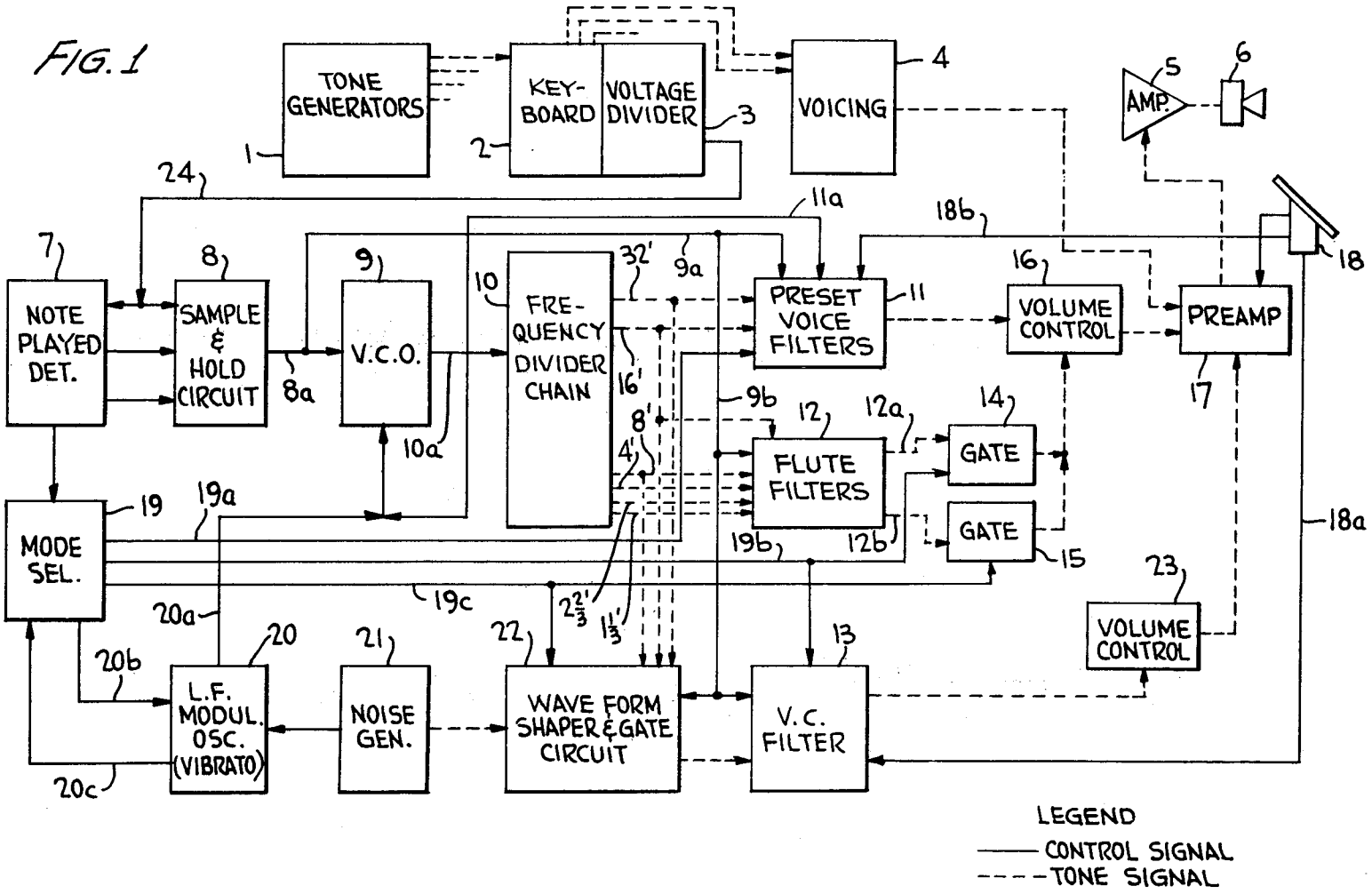
FIG. 1 is a block diagram of a preferred embodiment of the invention.

Block Diagram, FIG. 1

Reference is made to FIG. 1, wherein an electronic organ is illustrated as including a plurality of tone generators 1, each of which may be composed of plural independent oscillators, one for each note of the organ, or may involve frequency dividers. In the latter case there are traditionally twelve master oscillators for each generator, covering the uppermost octave of notes, from which lower octave tone signals of a manual are derived by frequency division. In the alternative and in accordance with the more recent practice, there is a single master oscillator from which all notes of a manual are derived by rate scaling. In any event, the outputs of the tone generators are conventionally selected by gates controlled from keyboard 2. The selected tone signals are passed through voicing or tone coloring circuits 4, selected by tabs (not shown). The outputs of the voicing circuits 4 are applied to the input of a pre-amplifier 17, which in turn drives a power amplifier 5, and a loudspeaker 6, or other acoustic radiating system. The gain of the pre-amplifier 17 is controlled by an expression pedal 18 so that tone amplitude is increased as the pedal is depressed. This much is conventional and is contained in many presently commercial electronic organs.

The present invention includes a tone synthesizer that is activated simultaneously, in superposition, with the conventional organ in response to depression of the same keys on keyboard 2 as the keys that control gating of generators 1. The output of the synthesizer is controlled by several operating modes. The various operating modes are selected by the musician adjusting certain buttons that control switches of mode selector 19. These modes and the switch labels are: (1) reiteration; (2) percussion; (3) normal (or continuous); (4) fast attack; (5) slow attack; and (6) sustain. Closure of the switches results in simulation of the various effects. In the detailed circuit description, switches associated with the buttons are functionally described without reference to ganging arrangements.

Control of the synthesizer tones is in response to activation of keyboard 2 that selects a voltage from voltage divider 3 and applies this voltage to lead 24, which represents, in terms of its magnitude, only the nomenclature of the highest pitch key played on keyboard 2, as disclosed in my copending application, Ser. No. 213,939, filed Dec. 30, 1971, and now U.S. Pat. No. 3,789,718. The voltage on lead 24 is supplied to sample and hold circuit 8 which provides on its output lead a voltage equal to or directly proportional to the voltage on lead 24. The voltage at the output of circuit 8 is derived for a time which endures even if all played keys are released, until a different key combination is struck. The sample and hold circuit 8 is activated in response to control signals provided by a note played detector 7 that is connected to leads 4 to respond to any change of the highest pitch key. The output frequency of a voltage controlled oscillator (V.C.O.) 9 is established primarily by the control voltage supplied to it by the sample and hold circuit 8.

The V.C.O. 9 provides at its output 10*a*, a square wave signal, the fundamental frequency of which corresponds primarily with the highest note called for by the actuated keys of keyboard 2. The output of V.C.O. 9 is applied to a frequency divider chain 10, which has several outputs for providing an array of square wave tone signals chordally and octavely related to the signal provided by V.C.O. 9. Typically, and for the purposes of the present disclosure, output frequencies of divider chain 10 correspond with organ footages denoted as 32′, 16′, 8′, 4′, as well as the partials $2\frac{2}{3}'$ and $1\frac{1}{3}'$.

The tone signals provided by frequency divider chain 10 are applied to two sets of tone color filters 11, 12 and wave shaper 22. Preset voice filters 11 for brass (e.g., trumpet, trombone, saxaphone and cello) simulation are responsive to the 32′ and 16′ outputs of chain 10; filters 12 for flute (e.g. flute) simulation are responsive to the 16′, 8′, $2\frac{2}{3}'$ and $1\frac{1}{3}'$ outputs of chain 10; and wave shaper 22, for unusual tone simulation, responds to the 32′, 16′ and 8′ outputs. Filters 11 and 12 and wave shaper 22 include an input circuit for each of the footages supplied to it. The tone signals supplied to filter 11 and wave shaper 22 are combined so that each includes a single output lead; filters 12 are arranged so that the 16′, 8′, 4′ tones are combined on a first output lead 12*a* and the $2\frac{2}{3}'$ and $1\frac{1}{3}'$ tones are combined on a second output lead 12*b*.

Wave shaper 22 is also responsive to signals from noise generator 21 and key activation pulses from note-played detector 7. In addition, the square wave tone signals derived from divider chain 10 are selectively processed, at the will of the musician, in wave shaper 22 as pulses, sawtooth waveforms or left substantially unmodified. The widths of the pulses are controlled in response to the output of sample and hold circuit 8 so that low note key depressions result in wider pulses than high note key depressions. Wave shaper 22 includes operator activated controls for selecting these various waveforms.

Brightness effects of the brass instruments simulated by filters 11 are achieved with variable waveshaping circuits controlled by depression of expression pedal 18, and for simulation of certain instruments, as a function of the length of time after a key has been played. In the latter case, as time progresses there is less attenuation of harmonic tones, whereby greater brightness is provided as time progresses after initial key activation. In response to depression of shoe 18, the harmonic content of the tone is increased by another waveshaping circuit so as to provide greater brightness as dynamic level increases. Filters 11 also include means for simulating brass attack characteristics by amplitude modulating the tone signals fed thereto with an envelope that includes plural exponential characteristics.

Filters 12 consist of a series combination of a voltage controlled amplifier and a fixed low pass filter. The gain characteristic of the voltage controlled amplifier is proportional to the output voltage of sample and hold circuit 8. Thus the gain of the voltage controlled amplifier is proportional to the fundamental frequency of the input. This causes the output of the fixed low pass filter to remain constant with regard to fundamental frequency over a given input frequency range while attenuating the harmonics of the fundamental frequency input at a fixed db per octave rate.

Filter 11 and wave shaper 22, as well as linear gates 14 and 15 (which may take a form disclosed in U.S. Pat. No. 3,549,779) are responsive to control signals derived from note played detector 7, as coupled through mode selector 13, a predetermined time, e.g., 20 milliseconds, after the first note of a key combination has been played. The control signals enable the tone signals to be passed through filter 11 and wave shaper 22, as well as gates 14 and 15; these circuits block passage of the tone signals until derivation of the control signals. Because of the delayed enabling, if several keys are activated substantially simultaneously, e.g., within 20 milliseconds of each other, the tones derived from filter 11, wave shaper 22 and gates 14 and 15 are responsive only to the highest pitch note played, regardless of which key was actually struck first. If the musician selects a continuous, rather than percussive, mode, tonal signals may be derived from gates, 14 and 15 and wave shaper 22 as long as a key is depressed or, at the will of the musician, a sustain effect after key release can be provided for tones derived from gate 14 and wave shaper 22. On the other hand, if the percussive mode is selected, control signals supplied by mode selector 19 to gates 14, 15 and wave shaper 22, enable the wave shaper and gate 14 to provide a controllable sustain, while gate 15 provides a fixed, short sustain.

In response to one or more keys being released while one or more other keys remain depressed, the tone signals derived from filter 11 and wave shaper 22, as well as from gates 14 and 15 are shifted to tones corresponding with the highest pitch of the remaining depressed keys. In response to all of the keys being released, the control signals from mode selector 19 are removed from filter 11, wave shaper 22, as well as gates 14, 15. Circuitry in sample and hold circuit and note played detector 7 delay the V.C.O. 9 from shifting frequency for a predetermined time, e.g., 40 milliseconds, after release of a key so that if several keys are substantially simultaneously released, tones associated with only the key having the highest pitch are derived, regardless of which key was actually the last to be released. If there is activation of a new key of higher pitch than any other depressed key, tones associated with the new key are derived from filters 11, wave shaper 22 and gates 14, 15 20 milliseconds after striking the new key even though another key was just previously released.

A random, vibrato tonal effect, on the signal derived from V.C.O. 9 is selectively derived from low frequency modulation oscillator 20 via lead 20*a*, the center frequency of which can be operator controlled. Random vibrator is particularly effective in simulating the characteristics of certain instruments, particularly brass tones. Modulation oscillator 20 frequency modulates V.C.O. 9 at rate, adjustable from 1 to 50 Hz. In the random mode, signal from noise generator 21 randomly varies the output frequency of modulator 20 about its center value. The amount of random variation is controllable, with typical maximum deviations of ± 15% about the selected center vibrato frequency.

In the reiterative mode, the output frequency of oscillator 20 is fixed, with no random variations imposed. In response to note played detector deriving a signal to indicate that any note is being depressed, oscillator 20 modulates V.C.O. 9 at a fixed frequency. In synchronism with the fixed frequency modulation supplied by oscillator 20 to V.C.O. 9, reiteration pulses are supplied by oscillator 20 to mode selector 19 which, in turn, under the control of the musician, may enable gates 14 and 15 for reiterative effects while a key is depressed.

Another feature of the circuitry including note played detector 7 and sample and hold circuit 8, is simulation of portamento, i.e., a smooth or continuous transition from one tone to another, in response to keys 2 being played legatissimo. If the keys are played staccatissimo there is no portamentation. The portamento effect is selectively provided by including in the sample and hold circuit 8 an electronically controlled switch that selectively short circuits a charging resistor for a storage capacitor responsive to the note indicating voltage supplied to the sample and hold circuit. If the keys are played legatissimo, note played detector 7 derives a control signal that open circuits the switch, whereby the storage capacitor is charged at a relatively slow rate through the charging resistor to provide a slow transition of the voltage controlling V.C.O. 9. In response to staccatissimo, note played detector 7 derives a control voltage that closes the switch to short circuit the charging resistance. Thereby, the voltage across the storage capacitor changes between voltages in discrete steps and the frequency of the oscillator is accordingly altered.

Another tonal effect provides for automatically flatting a note, i.e., reducing its frequency, as it is initially being voiced, to provide accurate simulation of certain instruments, particularly brasses. The amount of flatting is directly responsive to the note associated with the depressed key. To these ends, the output voltage of sample and hold circuit 8, indicative of the pitch of the depressed key, is coupled to filters 11, and thence selectively fed to V.C.O. 9 for a transient period when a new tone is being voiced. During the transient period the depressed key indicating voltage reduces the frequency of the V.C.O. to simulate the flatting effect.

The output of wave shaper 22 is fed via a voltage controlled filter 13 and volume control circuit 23 to the input of pre-amplifier 17 and thence via power amplifier 5 to loudspeaker 6. The outputs of filters 11 and 12, as coupled through gates 14 and 15, proceed via volume control circuit 16 to preamplifier 17, the gain of which is controlled as direct function of depression of expression pedal 18 so that as the pedal is depressed, gain and loudness are increased.

Voltage controlled, active filter 12 selectively provides a number of different effects on the tonal output signal of wave shaper 22. Filter 13 includes low pass, band pass, and high pass two pole transfer functions that are provided, either singly or in parallel combinations, for the signal derived from wave shaper 22. The Q and resonant frequency of all three transfer functions are the same. The Q is preset by the musician, while the resonant frequency may be selectively controlled by any of: the played note indicating voltage derived from sample and hold circuit 8, the gating envelope characteristic supplied to gate 14, or the position of expression pedal 18. The resonant frequency increases as the played note frequency increases, or with increased depression of expression pedal 18, or as the amplitude of the gating envelope increases.

KEY SWITCHES, NOTE PLAYED DETECTOR, AND SAMPLE AND HOLD CIRCUIT, FIG. 2

Figure 2:
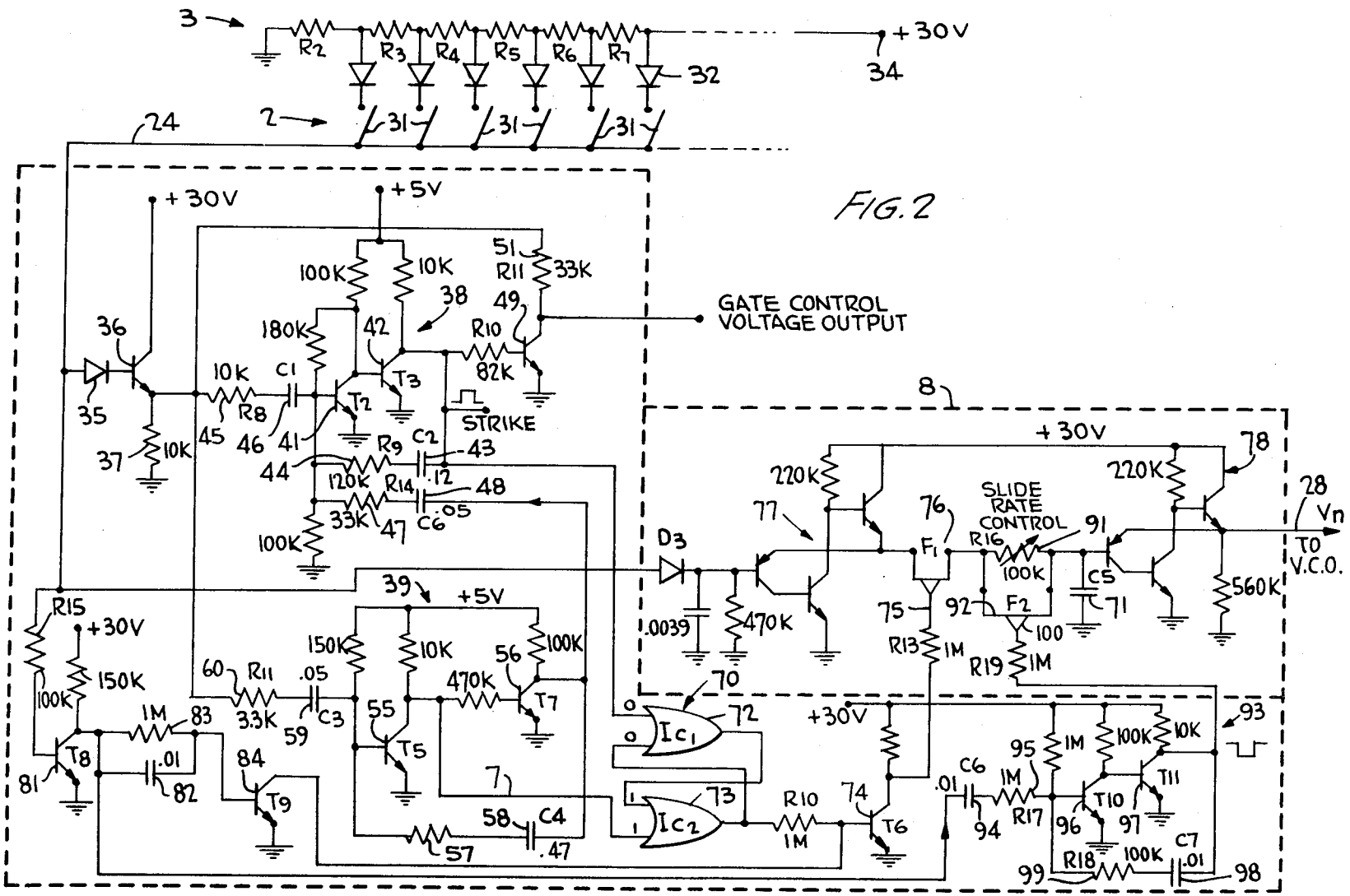
FIG. 2 is a circuit diagram of a keyswitch circuitry, a note played detector circuit, and sample and hold circuit included in FIG. 1.

Reference is now made to FIG. 2 of the drawing wherein there is illustrated a circuit diagram for the elements included in keyboard 2, voltage divider 3, note played detector 7 and sample and hold circuit 8 of FIG. 1. As in the copending application, the voltage derived on lead 24 is indicative of the highest note selected at a particular time, due to the nomenclature assigned to key switches 31, diodes 32 and the values of resistors 33 in voltage divider 3. Voltage divider 3 is connected to a positive d.c. source at terminal 34. Higher notes are associated with higher voltages.

The note indicating voltage on lead 24 is applied through blocking diode 35 to the base of NPN emitter follower transistor 36. Across emitter load resistor 37 of transistor 36 there is developed a voltage directly proportional to the voltage on lead 24. The voltage across emitter load resistor 37 is fed in parallel to conventional monostable multivibrators 38 and 39 which respectively function as note played and note release detectors.

Monostable multivibrator 38 includes NPN transistors 41 and 42 respectively normally biased to the off and on conditions, respectively. The collector of transistor 42 is connected to the base of transistor 41 via a feedback circuit including capacitor 43 and resistor 44, having values selected such that a positive pulse having a duration of 20 milliseconds is derived in response to a positive going pulse being supplied to the base of transistor 41. The positive going pulse may be derived from the emitter of transistor 36 via the a.c. coupling circuit including resistor 45 and capacitor 46 or from monostable multivibrator 39, as fed through the a.c. coupling circuit including resistor 47 and capacitor 48.

The collector of transistor 42 is connected to the base of NPN transistor 49, which is driven into saturation in response to the positive 20 millisecond pulse being derived at the collector of transistor 42. The collector of transistor 49 is connected through resistor 51 to be biased by the d.c. voltage at the emitter of transistor 36. Thereby, in response to none of keys 31 being closed, which results in transistor 36 being cut off, a zero emitter voltage of transistor 36 is fed to the collector of transistor 49, and the voltage at the collector of transistor 49 is maintained substantially at ground level. In response to any one of keys 31 being closed, the resulting positive voltage on lead 24 causes transistor 36 to conduct sufficiently to cause the emitter voltage thereof to increase to a level sufficient to bias transistor 49 into a state enabling it to be selectively cut off and driven into saturation in response to a pulse from monostable multivibrator 38. Thereby, in response to none of key switches 31 being closed or in response to a key switch being closed for less than 20 milliseconds, the voltage developed at the collector of transistor 49 is maintained substantially at ground. 20 milliseconds after a key switch 31 closure, the collector voltage of transistor 49 jumps positive in response to monostable multivibrator 38 changing state. The voltage developed at the collector of transistor 42 is normally at a relatively low level and jumps to a high level for the 20 milliseconds immediately after closure of a key switch 31; after the 20 millisecond period has elapsed, the voltage at the collector of transistor 48 returns to its low level.

Note release detector 39 includes NPN transistors 55 and 56 which are biased so that transistor 55 is normally in a conducting condition, while transistor 56 is normally cut off. The collector of transistor 56 is connected to the base of transistor 55 via a feedback path including series resistor 57 and capacitor 58, having values selected such that a pulse of approximately 40 milliseconds is derived from collector 56 in response to a negative voltage being applied to the base of transistor 55 by the emitter of transistor 36 via an a.c. coupling network including capacitor 59 and resistor 60. In response to the highest pitch note being released, as indicated by a decreased voltage on lead 24 and at the emitter of transistor 36, a negative pulse is supplied to the base of transistor 55 to drive that transistor into a cutoff condition, whereby transistor 56 is driven to a conducting condition. Transistors 55 and 56 remain in this condition for approximately 40 milliseconds, after which time they return to their normal state. Thereby, for 40 milliseconds after a key is released, positive and negative pulses are respectively derived at the collectors of transistors 55 and 56.

The positive going, trailing edge of the 40 millisecond pulse at the collector of transistor 56 is coupled through capacitor 48 and resistor 47 to the base of transistor 41 to change the state of monostable mulitvibrator 38. This positive going, trailing edge has the same effect on monostable multivibrator 38 as a positive pulse fed to the monostable multivibrator from emitter resistor 37, causing an additional 20 millisecond delay for a total of 60 milliseconds.

The positive going voltage developed at the collector of transistor 49 is utilized to gate tonal signals from preset voice filters 11, flute filters 12 and waveform shaper 22 into output circuitry. Thereby, there is a delay provided for all voices so that if a number of keys are struck within 20 milliseconds, the tones associated with only the highest pitch key are propagated even though the highest pitched key was not actually first struck. If a number of keys are released within 40 milliseconds of each other, while one or more keys remain activated, the tones for only the highest pitch key still depressed are propagated even though the different keys are released at different times. Also, if all of the keys are substantially simultaneously released, no positive going pulse is derived at the collector of transistor 49 causes a gating of the outputs of filters 11, 12 and 22 such that only the previously voiced key tones are propagated, regardless of the order in which the keys are released.

To control selective d.c. coupling of the note indicating voltage on lead 24 to storage capacitor 71 of sample and hold circuit 8, the voltages at the collectors of transistors 42 and 56 are fed to a flip-flop including NOR gates 72 and 73. Output terminals of NOR gates 72 and 73 are d.c. cross coupled in a conventional manner. One input of NOR gate 72 has a d.c. connection to the collector of transistor 42, while one input of NOR gate 73 has a d.c. connection to the collector of transistor 55. In response to the collector of transistor 42 changing from a low to a high positive d.c. voltage, the output of flip-flop 70, derived at the output terminal of NOR gate 73, is driven to a binary one, relatively high voltage state. In contrast, a positive voltage at the collector of transistor 55 causes flip-flop 70 to be driven so that the flip-flop output has a relatively low binary zero voltage level. Thereby, in response to a key being struck, the 20 millisecond pulse developed at the collector of transistor 42 activates flip-flop 70 so that a positive voltage is derived from the output of NOR gate 73; the positive voltage is maintained until the flip-flop state is altered in response to a positive voltage being derived at the collector of transistor 55, as occurs when a highest pitch key switch 31 is released.

In response to a positive or binary one voltage being derived from the output of gate circuit 73, storage capacitor 71 of sample and hold circuit 8 is connected to be responsive to the note indicating voltage on lead 24. To these ends, the positive voltage derived at the output of NOR gate 73 drives normally cutoff NPN transistor 74 into a conducting state. The collector of transistor 74 is connected to gate electrode 75 of field effect transistor (FET) 76 which functions as a first voltage controlled switch of sample and hold circuit 8. In response to transistor 76 being activated into a conducting state, current is drawn from gate electrode 75 to bias FET 76 into a conducting state.

As disclosed in the previously mentioned copending application, sample and hold circuit 8 includes an input circuit 77 and an output circuit 78, each of which includes three transistors for providing impedance isolation and substantially unity gain. Thereby, capacitor 71 is not loaded by circuit 78.

In response to a new high note key being depressed, the voltage on lead 24 is fed through input circuit 77 and the source drain path of FET 76 to storage capacitor 71. Thereby, changes in the voltage on lead 24 are coupled to capacitor 71 as long as NOR gate 73 is deriving a voltage indicating that a note is being played.

In response to a highest pitch note being released, while another note is still being played, capacitor 71 is momentarily decoupled, for 40 milliseconds, from the voltage on lead 24. Momentary decoupling of capacitor 71 occurs in response to transistor 74 being driven into cutoff by the output of NOR gate 73 returning to a binary zero level in response to the 40 millisecond positive pulse derived at the collector of transistor 55. After the 40 millisecond period has elapsed, the state of monostable multivibrator 38 is altered, whereby a positive pulse is derived at the collector of transistor 42. The positive pulse is coupled to the input of NOR gate 72, causing flip-flop 70 to change state back to the binary one condition. In response to the flip-flop 70 being returned to the binary one state, FET 76 again switches to a closed state and capacitor 71 is charged to the voltage of lead 24. Thereby, transient changes in the release of key switches 31, while one note remains depressed, are decoupled from capacitor 71 and the capacitor is responsive only to the voltage on lead 24, 40 milliseconds after the release has been performed.

The voltage on capacitor 71 is maintained fixed at a value corresponding with the highest pitch note after all keys are released because FET 76 is open circuited in response to all keys being released. To these ends, normally cut off NPN transistor 81 has its base connected to lead 24. In response to any of key switches 31 being closed, transistor 81 is driven into saturation, whereby its collector is substantially grounded. The negative going voltage at the collector of transistor 81 is fed through speed-up capacitor 82 and its shunted resistor 83 to the base of normally conducting NPN transistor 84, the collector of which is connected to shunt the base of transistor 74. In response to any note being played, transistor 84 is cut off, whereby the output voltage of NOR gate 73 controls the conducting state of transistors 74 and therefore FET 76. If none of key switches 31 is closed, transistors 81 and 84 are respectively biased to the off and on states, whereby transistor 84 shunts the emitter base path of transistor 74 to hold transistor 74 in a cutoff concondition and prevent FET 76 from conducting.

In summary, in response to a key switch 31 being closed, FET 76 is closed, whereby capacitor 71 is charged to the voltage on lead 24, causing voltage controlled oscillator 9 to oscillate at the frequency determined by the voltage on lead 28. In response to a note being released which causes a voltage on lead 24 to decrease, a 40 millisecond delay in a change of the voltage on capacitor 71 occurs, because FET 76 is open circuited for the 40 millisecond period.

If, after the 40 millisecond period has elapsed, no note indicating voltage is derived on lead 24, FET 76 remains open circuited and the voltage across capacitor 71 is maintained at the level corresponding with the previous highest pitch played note. If there is still a note depressed after the 40 millisecond period, the voltage corresponding with the new, lower pitch note is fed through FET 76 to capacitor 71. The voice corresponding with the new note is sounded 20 milliseconds after the voltage corresponding with the note is stored on capacitor 71, by virtue of the positive going voltage derived at the collector of transistor 49. If during the 40 millisecond delay period associated with note release detector 39, a new note is played which causes the voltage on lead 24 to increase, FET 76 is immediately closed and the voltage across capacitor 71 is driven to the new value. 20 milliseconds after the new, higher pitch note has been played, a positive going pulse is derived at the collector of transistor 49 to enable tones associated with the new note to be derived.

A further feature of sample and hold circuit 8 is simulation of portamento. To these ends, the source drain path of FET 76 is connected to capacitor 71 through variable resistor 91 that is connected across the source drain path of FET 92, which functions as an electronic switch in response to the output voltage of monostable multivibrator 93, included in note played detector 7. In response to legatissimo playing, as detected in a manner described infra, the source drain path of FET 92 is open circuited, whereby capacitor 71 is charged through resistor 91. In response to staccatissimo playing, the source drain path of FET 92 functions as a short circuit for resistor 91, whereby the voltage of capacitor 71 is changed in discrete steps, substantially instantaneously. In response to instantaneous step changes in the voltage of capacitor 71, the frequency of oscillator 9 is stepped. In contrast, a slow variation in the change in the freqency of oscillator 9 occurs in response to a smooth transition of the voltage across capacitor 71. The charging rate for capacitor 71 while portamento occurs is selected by the musician adjusting the value of resistor 91 to achieve the desired rate of change in the frequency of oscillator 9.

Detection of the legatissimo playing is provided by connecting the input of monostable multivibrator 93 to the collector of transistor 81 through an a.c. coupling circuit comprising capacitor 94 and resistor 95. Monostable multivibrator 93 includes NPN transistors 96 and 97 respectively normally biased to the conducting and non-conducting states. The collector of transistor 97 is connected to the base of transistor 96 by capacitor 98 and resistor 99, having values selected so that monostable multivibrator 93 derives an 8 millisecond pulse in response to each negative transition at the collector of transistor 81. Thereby, each time a new set of keys is depressed while no other keys are depressed, monostable multivibrator 93 is activated to derive an 8 millisecond negative pulse at the collector of transistor 97. The negative pulse is d.c. coupled to the gate 100 of FET 92, causing the FET to be driven into a conducting state, short circuiting resistor 91. Thereby, in response to all keys of one set of keys being released prior to any keys of a second set being depressed (i.e. staccatissimo note playing), capacitor 71 is instantly charged to the voltage associated with the new note on lead 24. If, however, the notes are played so that one key is not released until a second key has been depressed (legatissimo note playing), negative pulses are not derived at the collector of transistor 97 and a high impedance path exists through resistor 91 to capacitor 71 to provide gradual voltage change.

MODE SELECTOR, FIG. 3

Figure 3:
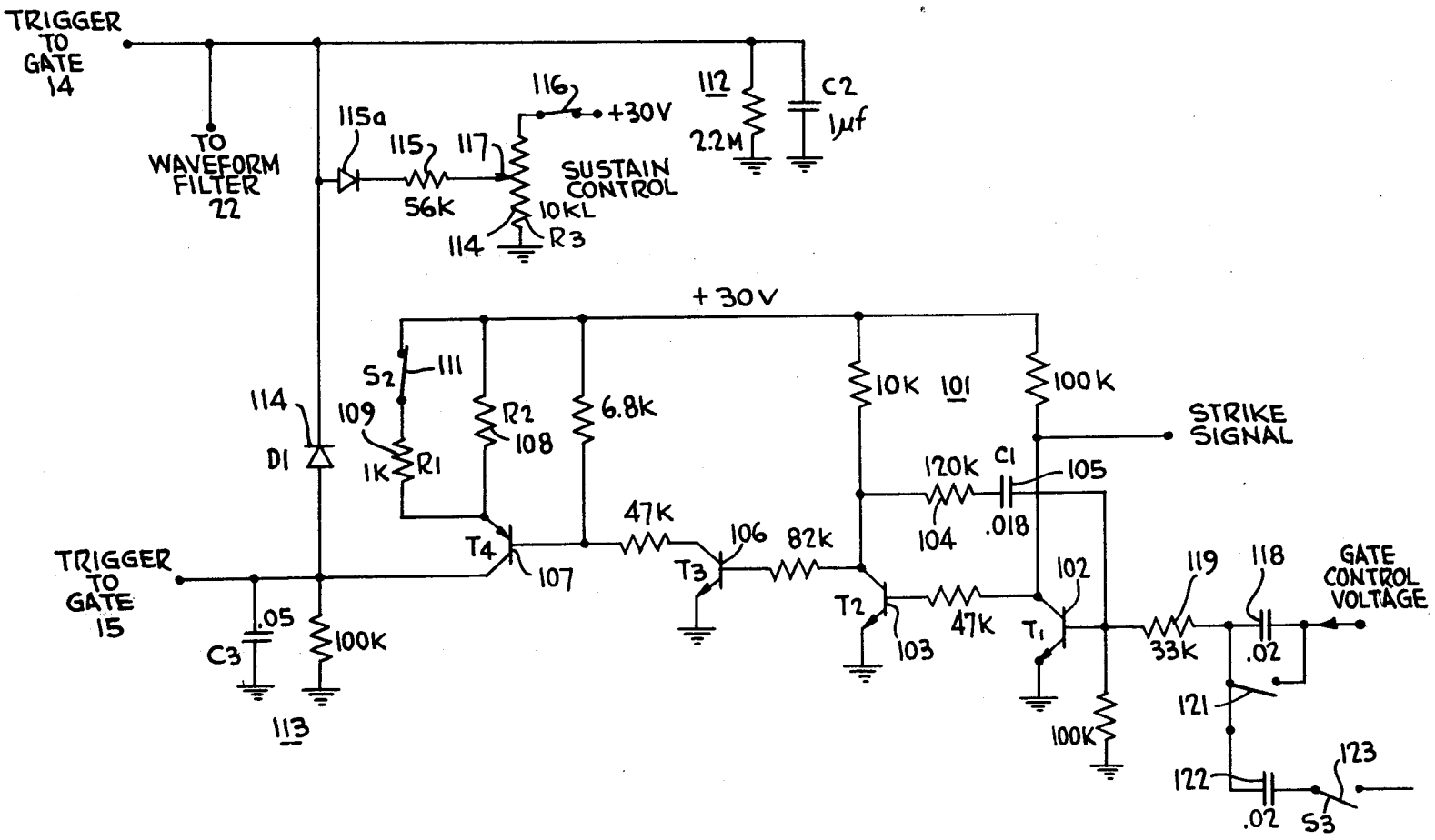
FIG. 3 is a circuit diagram of mode selector circuitry included in FIG. 1.

Reference is now made to FIG. 3 of the drawing wherein there is illustrated a circuit diagram of a portion of mode selector 19. The circuits illustrated in FIG. 3 are concerned with controlling trigger voltages for linear gates 14 and 15, as well as for a gate included in wave shaper 22. Switches included in mode selector 19 and which functionally are related to other circuits of the system are not illustrated in FIG. 3, but are illustrated in circuit diagrams associated with the particular circuits.

Mode selector 19 includes a monostable multivibrator 101 comprising NPN transistors 102 and 103. The collector of transistor 103 is connected to the base of transistor 102 through a series circuit including resistor 104 anc capacitor 105, having values selected so that the monostable derives a short duration pulse, on the order of 8 milliseconds, in response to normally cut off transistor 102 being driven into a conducting state in response to a positive pulse being applied to its base. The resulting, short duration pulse derived at the collector of transistor 103 is coupled to the base of inverting NPN transistor 106, the collector of which is connected to the base of PNP transistor 107 which is normally biased into a cut off condition. Transistor 107 is activated in a conducting state in response to transistor 106 being driven into a conducting state, whereby transistor 107, when turned on, functions as a constant current source. To provide different attack rates the current derived from the collector of transistor 107 is controlled by varying the impedance of the transistor emitter circuit. In a slow attack configuration, the emitter of transistor 107 is connected to a positive +30 volt d.c. source through 4.7K resistor 108, and in a fast attack configuration, while switch 111 is closed, the emitter of transistor 107 is connected to the +30 volt source through the parallel combination of resistor 108 and 1K resistor 109, whereby the current of the second configuration is approximately five times that of the first.

The constant current derived from the collector of transistor 107 is applied to a pair of ramp forming networks 112 and 113 which are connected to trigger inputs of gates 14 and 15, respectively; the ramp derived from network 112 is also applied as an enabling input to the gate of wave shaper 22. Each of networks 112 and 113 includes the parallel combination of a capacitor and a resistor; the capacitor and resistor of network 112 preferably have values of one microfarad and 2.2M. and the capacitor and resistor of network 113 preferably have values of approximately 0.05 microfarads and 100K. so that the charging and discharging rates of the former are considerably less than the latter. The voltage across network 112 is decoupled or isolated from the voltage developed across circuit 113, by virture of diode 114, the anode of which is connected to network 113, and the cathode of which is connected to network 112.

To control the decay rate of the ramp voltage derived from circuit 112 and thereby provide a sustain effect, potentiometer 114 is connected to circuit 112 via coupling resistor 115 and isolation diode 115*a*. Potentiometer 114 is selectively connected to a +30 volt d.c. source by switch 116. The position of slider 117 of potentiometer 114 controls the decay rate of the trailing edge of the ramp voltage derived by circuit 112.

The conducting state and current magnitude of transistor 107 are determined by the system mode of operation, as is the presence or absence of the sustain effect, as derived across network 112. In response to the system being in a percussive mode, transistor 107 is activated into a conducting state for an 8 millisecond period in response to each positive going transistion at the collector of transistor 49, FIG. 2, and switch 111 is closed so that a relatively large current is derived from transistor 107. The relatively large current derived from transistor 107 causes capacitors of circuits 112 and 113 to be quickly charged to a relatively high voltage, to provide fast attack and rapid opening, i.e., enabling, of gates 14, 15 and the gate of waveform shaper 22. These results are achieved by connecting the collector of transistor 49 to the base of normally cut off transistor 102 through an a.c. coupling network comprising capacitor 118 and resistor 119.

After the 8 millisecond on-time of transistor 107 has elapsed, the enabling voltages supplied by circuit 112 to gate 14 and wave shaper 22 and the enabling voltage supplied by circuit 113 to gate 15 decrease. Because of the relatively small resistor and capacitor circuit 113, the decay of the voltage supplied to gate 15 is relatively fast, to cause relatively rapid cutoff of gate 15. In contrast, the resistor and capacitor of circuit 112 are selected to enable a sustain effect to be provided. In the percussive mode, the sustain duration is variably controlled by adjusting the position of slider 117 and closing switch 116. With the position of slider 117 adjusted toward the top of slider 114 a relatively long sustain effect is provided, whereby gate 14 and wave shaper 22 remain activated for an appreciable time period to simulate the sustain effect of a percussive instrument.

In a second mode of operation, the continuous mode, gates 14 and 15 and the gate in wave shaper 22 are enabled 20 milliseconds after any of key switches 31 are depressed and remain enabled until all keys are released. To these ends, the collector of transistor 49 is connected via a d.c. path to the base of transistor 102 through resistor 119 and switch 121 which shunts capacitor 118 and is closed when the system is operated in a continuous mode. In response to any of key switches 31 being depressed for more than 20 milliseconds, a positive voltage is derived at the collector of transistor 49 and is coupled through switch 121 to drive transistor 102 into a conducting state. Transistor 102 remains in the conducting state as long as a positive voltage is applied to its base, whereby transistor 107 is biased into a conducting state to supply constant current to circuits 112 and 113; thereby, gates 14, 15 and the gate in waveform shaper 22 pass tone signals supplied to them as long as any of key switches 31 are depressed. In the continuous mode, the attack rate can, at the option of the musician, be either slow or fast by opening of closing switch 111. Similarly, by closing and opening switch 116, the sustain effect can be a relatively long controllable time or a fixed shorter time for tones fed through gate 14 and the gate of wave shaper 22.

In the reiterative mode, fast attack enabling voltages are derived from circuits 112 and 113 periodically, at a frequency determined by the modulation oscillator 20 (FIG. 1), for as long as the key switches remain activated. To these ends, switch 111 is closed and the base of transistor 102 is a.c. coupled by series connected resistor 119, capacitor 122 and switch 123 to be responsive to square waves derived by modulation oscillator 20. Switch 123 is closed by the musician when the system is in the reiterative mode, at which time modulation oscillator 20 is adjusted to derive a random frequency output, whereby monostable multivibrator 101 derives an 8 millisecond pulse in response to each positive going transition of the modulation oscillator output square wave. Enable voltages are derived by circuits 112 and 113 in response to monostable multivibrator 101 being triggered by square wave input in the same manner as described for activation of the multivibrator in response to the positive going trailing edge of the voltage derived at the collector of transistor 49.

WAVEFORM SHAPER 22, FIG. 4

Figure 4:
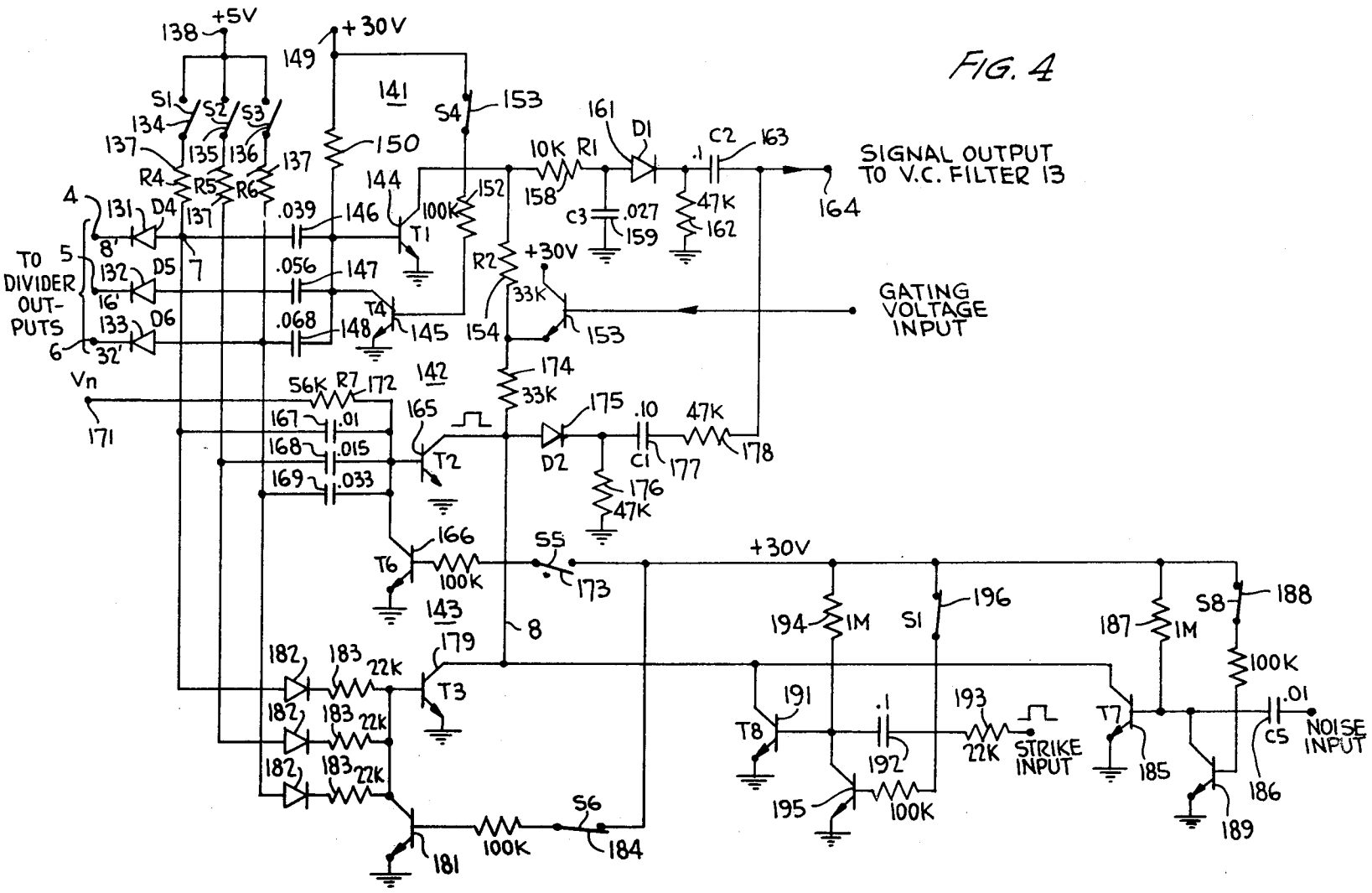
FIG. 4 is a circuit diagram of a wave form shaper included in FIG. 1.

The ciruit of FIG. 4 responds to the tones derived from the 8, foot, 16 foot, and 32 foot outputs of frequency divider chain 10 to selectively synthesize sawtooth voltages, pulses and square waves having the same fundamental frequency as the selectively coupled tone input signals. The duration of the pulses is dependent upon the note of the highest pitch key. The derived square waves are substantial replicas of the input square waves. The different waveforms derived in response to the square wave tones fed to FIG. 4 enable unusual tonal effects to be attained and different musical instruments to be simulated; for example, the sawtooth, pulse and square waves can be utilized to respectively simulate piano, oboe and clarinet instruments. These waveforms can be selectively modified by voltage controlled filter 13 to provide other unusual effects. Waveform shaper 22 is also selectively responsive to random, i.e., noise signals, as well as a pulse each time the state of monostable multivibrator 38, FIG. 2, is changed in response to a new high note signal level being derived on lead 24. The noise input can simulate acoustic effects of, for example, the wind, surf, or a brush hitting a snare, while the pulse derived from monostable multivibrator 38 can provide click effects or noise.

Control of which one or combination of the 8 foot, 16 foot or 32 foot tones from frequency divider chain 10 into waveform shaper 22 is provided by selectively forward biasing diodes 131, 132 and 133, having cathodes respectively connected to the 8 foot, 16 foot and 32 foot outputs of frequency divider chain 10. Diodes 131–133 are selectively forward biased by applying positive voltages to anodes thereof in response to closure of normally open switches 134, 135 and 136, which are respectively connected to the diode anodes via resistors 137 so that a +5 volt d.c. level at terminal 138 can forward bias the diodes. The tone signals fed through diodes 131–133 are fed in parallel to wave synthesizing networks 141, 142 and 143, which respectively enable selective derivation of sawtooth, pulse and square waves.

Sawtooth wave generator 141 includes NPN transistors 144 and 145 which are responsive to the square wave inputs fed through diodes 131–133 to derive a pulse having a width indicative of the footage passed by the diodes. To these ends, the anodes of diodes 131, 132 and 133 are connected , via capacitors 146, 147 and 148, to the base of transistor 144 which is normally forward biased by the connection of resistor 150 to the +30 volt d.c. source at terminal 149. The values of capacitors 146, 147 and 148 are selected in conjunction with the value of resistor 150 to provide an on-time for pulses derived by transistor 144 such that the pulse width is directly related to the footage of the input tone, i.e., the pulse width for the 8 foot tone is narrower than the pulse widths for the 16 foot and 32 foot tones.

Transistor 145 is selectively maintained in a saturated, forward biased condition by connecting its base to the +30 volt supply at terminal 149 through resistor 152 and switch 153, which is opened by the musician when he wants to synthesize sawtoothtype waves. When switch 153 is closed the collector of transistor 145 is grounded, whereby the base of transistor 144, which is shunted by the collector of transistor 145, cannot be forward biased and sawtooth variations cannot be derived.

To enable the sawtooth, as well as the other waveforms derived by the waveform shaper 22 to be derived, gating NPN transistor 153 is provided. The base of transistor 153 is connected to be responsive to the voltage developed across network 112, FIG. 3, so that transistor 153 is driven into a conducting stage from a normally non-conducting state only while a positive voltage of sufficiently high level is derived from network 112. As described supra the voltage lever derived from network 112 controls attack rate and sustain times and is dependent upon the system operating mode. In response to the base of transistor 153 being forward biased, current flows from the +30 volt source connected to the transistor collector, to the transistor emitter and thence to the collector of transistor 144 via resistor 154, to enable current to be delivered to the collector of transistor 144.

In operation, negative going transitions of the square waves coupled to the base of transistor 144 from the anodes of diodes 131–133 drive transistor 144 into a cut off condition. Transistor 144 remains in a cut off condition until the voltage across the capacitor 146, 147 or 148 responsive to the square waves fed through the forward biased one of diodes 131–133 reaches a voltage sufficient to activate transistor 144 into a saturated state. Thereby, the cut off duration is determined by the values of capacitors 146–148 and resistor 150, whereby a positive voltage is derived at the collector of transistor 144 for a time period indicative of the footage fed to the base of transistor 144 and the widths of generated pulses are accordingly controlled. The frequency of the generated pulses equals the frequency of the input square waves.

The voltage at the collector of transistor 144 is fed to an integrating circuit including resistor 158 and capacitor 159. In response to the positive voltage being derived at the collector of transistor 144, capacitor 159 is charged and the capacitor is subsequently discharged through the emitter collector path of transistor 144 in response to the transistor returning to a saturated condition. The time duration of the increasing ramp derived by the integrating capacitor 159 is determined by the duration of the pulse derived at the collector of transistor 144, while the decay rate of the sawtooth wave derived from the integrating capacitor is substantially constant. Thereby, the leading edge duration of the sawtooth wave is controlled by which of the footage is fed through diodes 131–133, while the sawtooth frequency equals the fundamental frequency of the square wave input from divider chain 10. The sawtooth waveform developed across integrating capacitor 159 is coupled to output terminal 164 by diode 161, the cathode of which is connected to resistor 162, and a relatively large d.c. isolating capacitor 163.

To derive pulses having widths determined by the note of the highest note depressed key, the anodes of diodes 131–133 are connected to NPN transistors 165 and 166 which are interconnected with each other, as well as the tone signal and power supply voltages, in a manner similar to the connections of transistors 144 and 145. In particular, the base of transistor 165 is connected to the anodes of diodes 131, 132 and 133 by capacitors 167, 168 and 169, having values selected with criteria similar to those for determining the values of capacitors 146–148. The charging rate of capacitors 167–169 is controlled by the amplitude of the highest note indicating voltage on lead 24, which is d.c. coupled to the base of transistor 165 via terminal 171 and resistor 172 to control the extent of base forward bias of the transistor. In response to variations in the amplitude of the voltage at terminal 171, the cut off time of transistor 165 is varied. In response to a negative going pulse being supplied through one of diodes 131–133 and capacitors 167–169, to the base of transistor 165, the transistor is driven into cut off and remains cut off until the voltage across one of capacitors 167–169 reaches a level sufficient to cause the transistor to be forward biased and driven into saturation, which occurs at a time controlled by the voltage on terminal 171, value of resistor 172 and which of the capacitors is responsive to the square wave input.

To enable transistor 165 to be selectively activated and cut off to provide derivation of the pulses, switch 173 is connected between a positive d.c. power supply voltage and the base of transistor 166. In response to switch 173 being closed, the emitter collector path of transistor 166 shunts the emitter base junction of transistor 165 to prevent conduction of transistor 165. Collector current flow of transistor 165 is controlled in response to the enable voltage derived by network 112, in a manner similar to that of transistor 144, by the connection of the collector of transistor 165 to the emitter of transistor 153 through resistor 174. Pulses derived at the collector of transistor 165 are fed to output terminal 164 via a pulse shaping circuit inclucing diode 175 which is connected to load resistor 176, the voltage across which is coupled to the output terminal via a low impedance a.c. coupling circuit comprising capacitor 177 and resistor 178.

The derivation of replicas of the square wave voltages selectively coupled through diodes 131–133 is performed with circuit 143, that includes NPN transistors 179 and 181, connected in a manner similar to transistors 165 and 166. The base of transistor 179 and collector of transistor 181 are connected to the anodes of diodes 131, 132 and 133 by a d.c. path including diodes 182 and current limiting resistors 183; the cathodes of diodes 182 are connected to the base of transistor 179 to isolate the base from negative transients that might be derived from capacitors 146–148 and 167–169. Square waves are derived at the collector of transistor 179 by the musician opening switch 184, and are fed through the circuit including diode 175, resistors 176 and 178 and capcitor 177 to terminal 164 in response to current being supplied to the collector of transistor 179 by the emitter of transistor 153.

The noise signal from noise generator 21 is selectively coupled to output terminal 174 under the control of the states of transistor 153 and switch 188. To this end, the output signal of noise generator 21 is fed to the base of NPN transistor 185 via an a.c. coupling circuit including capacitor 186 that is connected to the noise source. Transistor 185 is normally forward biased by the connection of its base to the plus d.c. power supply through resistor 187. Forward bias for the base emitter junction of transistor 185 is removed by closing switch 188, which causes normally cut off transistor 189 to be forward biased and shunt the emitter base junction of transistor 185, thereby driving transistor 185 to cut off. In response to switch 188, however, being open circuited, the noise input signal is fed to terminal 164 via diode 175, resistors 176 and 178 and capacitor 177 when transistor 153 is conducting, by virtue of the d.c. connection between the collector of transistor 185 and the emitter of transistor 153.

To derive a relatively short duration pulse each time a new high pitch key is struck, the base of NPN transistor 191 is a.c. coupled via capacitor 192 and resistor 193 to the collector of transistor 42 of note played detecting multivibrator 38, FIG. 2. Transistor 191 is normally biased to a conducting state by the connection of its base to the positive d.c. power supply via resistor 194. In response to the trailing, negative going edge of the pulse derived at the collector of transistor 42, which occurs 20 milliseconds after monostable multivibrator 38 is driven into a transient state in response to a new high note being struck, transistor 191 is driven to cut off and a positive pulse is supplied to terminal 164 through diode 175, resistors 176 and 178 and capacitor 177. The duration of the pulse is determined by the values of capacitor 192 and resistor 193, components which control the length of time transistor 191 remains cut off. The pulse can be derived only when transistor 153 has been driven into a conducting state. To prevent the pulses derived in response to each activation of monostable multivibrator 38 being coupled to output terminal 164, the emitter base junction of transistor 191 is selectively shunted. Shunting occurs in response to the emitter collector path of transistor 195 being biased into a conducting state by the musician closing switch 196 that selectively connects the positive d.c. power supply voltage to the base of transistor 195.

VOLTAGE CONTROLLED OSCILLATOR AND CONTROL CIRCUITRY THEREFOR, FIG. 5

Figure 5:
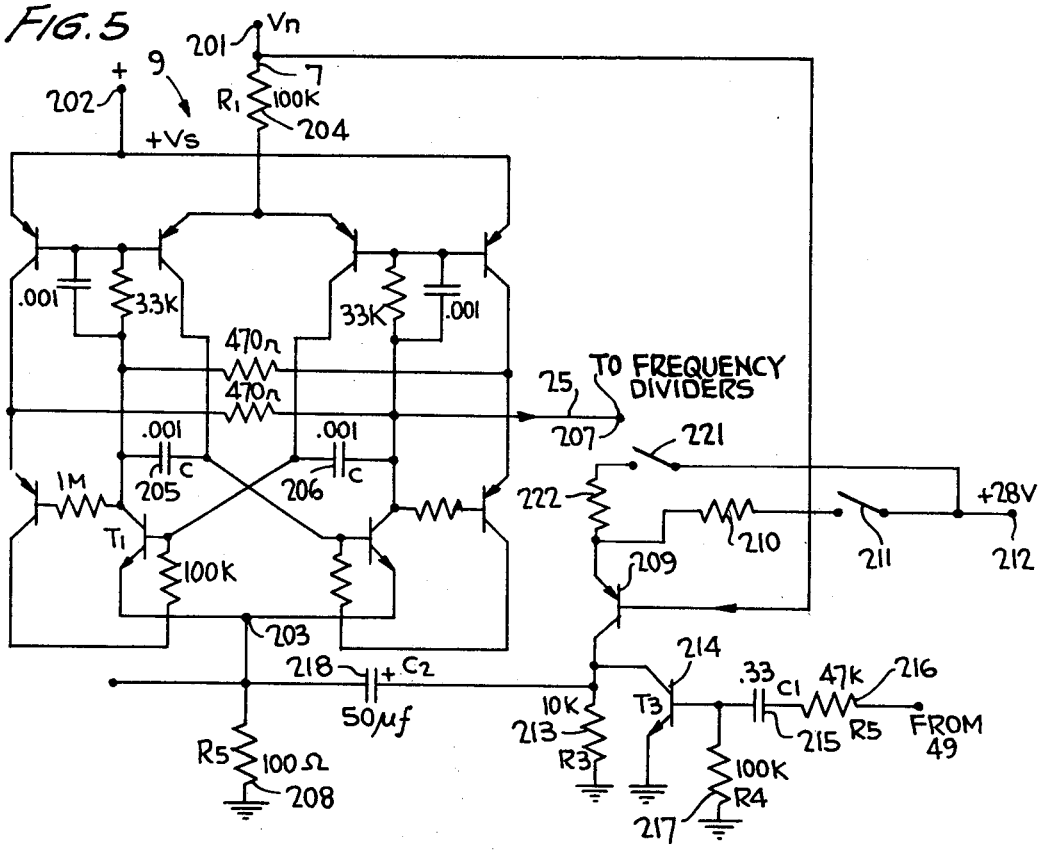
FIG. 5 is a circuit diagram of a voltage controlled oscillator and related circuits of FIG. 1.

Reference is now made to FIG. 5 of the drawing wherein there is illustrated a circuit diagram of voltage controlled oscillator 9 and control circuitry therefor. The voltage controlled oscillator basic circuitry is substantially the same as that disclosed in my previously-mentioned copending application, so that a detailed description of the transistors, associated resistors and capacitors is not required herein. The frequency of oscillator 9 is controlled, inter alia, by the amplitude of the d.c., note indicating voltage derived from the output of sample and hold circuit 8, which is d.c. coupled to oscillator input terminal 201. The frequency of the oscillator is also controlled by the magnitude of: the positive d.c. power supply voltage at terminal 202, a variable voltage at terminal 203, the value of resistor 204 which feeds the voltage at terminal 201 to the oscillator, and the value of substantially equal capacitors 205 and 206 that cross couple the collectors and bases of the oscillator transistors together.

The square wave output frequency of the oscillator, as derived at its output terminal 207 , which is connected as an input to frequency divider chain 10, is expressed as:

$$f_n = \frac{V_n - V_s}{2RC(V_s - V_v)} \quad (1)$$

where:

$f_n$ = output frequency,
$V_n$ = input voltage at terminal 201,
$V_s$ = D.C. power supply voltage at terminal 202,
$V_v$ = voltage at terminal 203,
R = value of resistor 204,
C = value of each of capacitors 205 and 206.

From Equation (1), since $V_s$ is greater than $V_v$ the frequency of oscillator 9 is related to variations in the amplitude of the voltage $V_v$ in such a manner that as the voltage at terminal 203 increases, the output frequency increases. The voltage at terminal 203 is selectively varied in response to the output of modulation oscillator 20 and to provide flatting effects for certain musical instruments, particularly brasses, which are flatter when first voiced than in a steady state condition. Vibrato modulation of the frequency of oscillator 9 is attained by feeding the output of modulation oscillator 20 to terminal 203. The frequency of modulation oscillator 20 can either be fixed in the range between approximately 1 to 50 Hertz, normally adjusted for a vibrato rate of approximately seven Hertz, or randomly varied about a mean frequency within this range. In response to the periodic or random variations in the amplitude of the wave derived by modulation oscillator 20, the frequency of oscillator 9 is modulated.

The flatting effect is a transient function of the note indicating signal fed by voltage divider 3 to lead 24. As the pitch of the note increases, the flatting effect is decreased. To these ends, the voltage at terminal 201, indicative of the highest note resulting from depression of key switches 31, is selectively gated to terminal 203 at a time when the tone corresponding with the note is initially being sounded.

For a realistic simulation of the different brass tones, the amount of flatting necessary is different for different instruments. For example, a trombone is initially voiced flatter than a trumpet, whereby it is necessary to have more flatting when simulating a trombone than for simulation of a trumpet. When it is desired to provide the flatting effect for one of the instruments, one of several different positive d.c. voltages is applied to the emitter of PNP transistor 209 by closing one of switches 211 or 221 which are connected to a positive d.c. supply voltage at terminal 212 through resistors 210 and 222 having different values. If switch 211 and resistor 210 are provided for trumpet flatting and switch 221 and resistor 222 for trombone flatting, the value of resistor 222 is smaller than that of resistor 210 to provide a higher emitter current for the trombone and therefore greater trombone flatting.

In response to one of switches 211 or 221 being closed, the difference in voltage amplitude between the note indicating voltage on lead 201 and the emitter voltage of transistor 209 is derived at the collector of transistor 209 which is connected to ground via load resistor 213 that is shunted by the normally cut off emitter collector path of NPN transistor 214. Transistor 214 is driven into a conducting state in response to the positive going trailing edge of the voltage developed at the collector of transistor 49, which is fed to the transistor base via the a.c. coupling circuit including capacitor 215 and resistors 216 and 217. A terminal common to the collectors of transistors 209 and 214 is connected to terminal 203 and across relatively small load resistor 208 via relatively large capacitor 218. When transistor 214 is cut off, capacitor 218 is charged to a voltage which is dependent upon the emitter current of transistor 209 and the value of resistor 213 so that as the highest note indicating voltage, $V_n$, increases the voltage on capacitor 218 decreases.

In response to transistor 214 being transiently activated into a conducting state in response to the positive going, trailing edge transition derived from the collector of transistor 49, capacitor 218 is suddenly discharged through the collector-emitter path of transistor 214. Thereby, the voltage at terminal 203 suddenly decreases by an amount equal to the voltage on capacitor 218 and therefore related to the value of $V_n$. This applies a negative transient voltage at terminal 203 which causes oscillation to transiently go flat. Capacitor 218 exponentially recharges after transistor 214 returns to a non-conducting state. Because the amplitude of the sudden decrease in the voltage at terminal 203 is inversely related to the highest note, greater flatting is provided for lower pitch tones than for higher ptich tones.

BRASS PRESET VOICE FILTERS, FIG. 6

Figure 6:
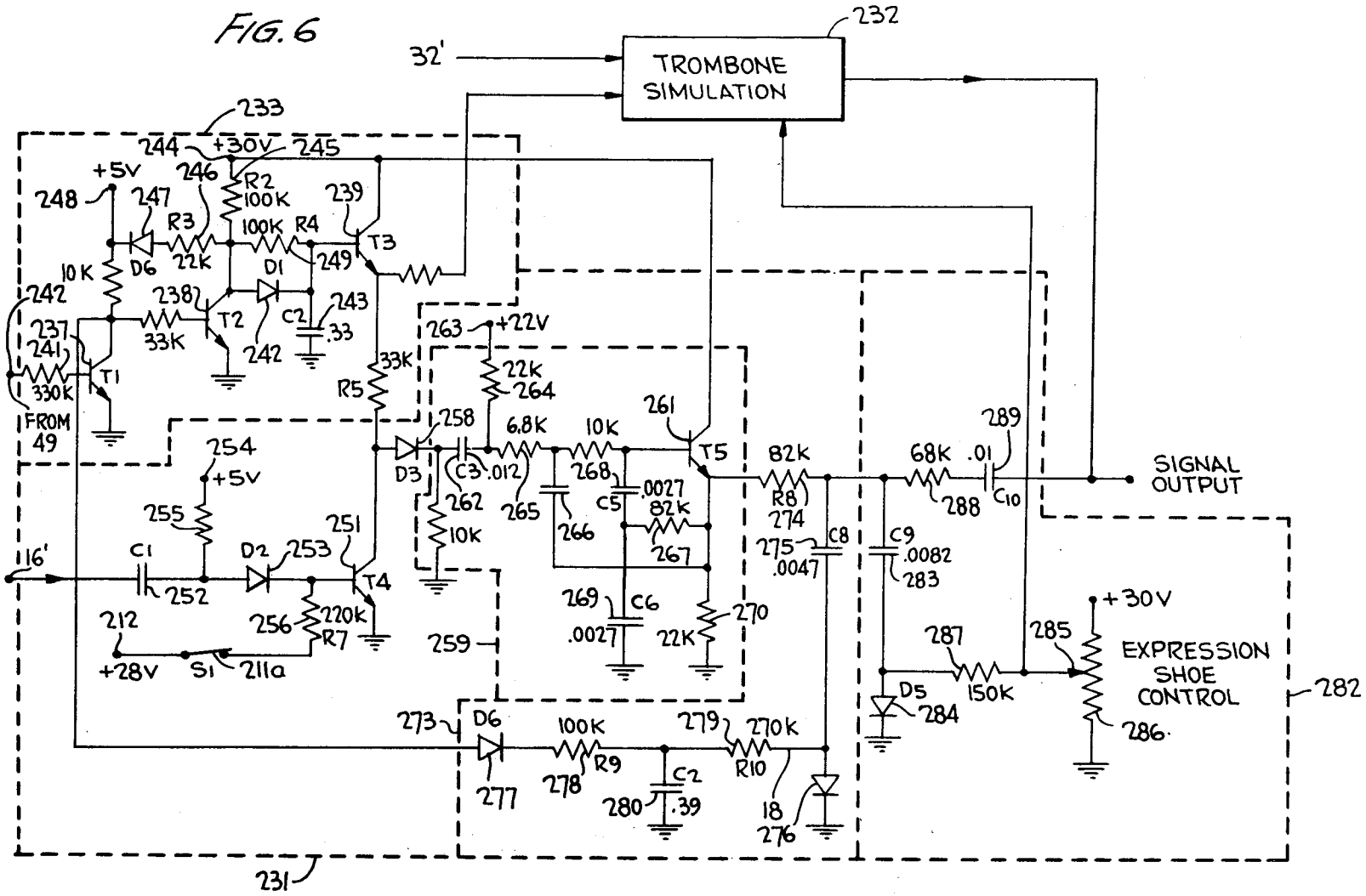
FIG. 6 is a partial block, partial circuit diagram of brass filters used in FIG. 1.

Reference is now made to FIG. 6 of the drawing wherein there is illustrated a circuit diagram of a complete channel 231 for simulation of one brass instrument, the trumpet, as well as control circuitry 233 for the trumpet simulation channel and a further channel 232 for simulating a second brass instrument, e.g., the trombone. Trumpet simulation channel 231 is driven by the 16 foot output of frequency divider chain 10, while the trombone simulating channel 232 is driven by the 32 foot output of the frequency divider chain. Channels 231 and 232 are driven in parallel by an output signal derived by envelope shaping network 233 which is responsive to the positive going voltage derived at the collector of transistor 49, FIG. 2. Channels 231 and 232 respond to the signals derived by envelope shaper 233 to provide simulation of the attack rate, attack tone color change, tone color change as a function of dynamic level, and overall tone quality for the two brass instruments being simulated.

Figure 7:
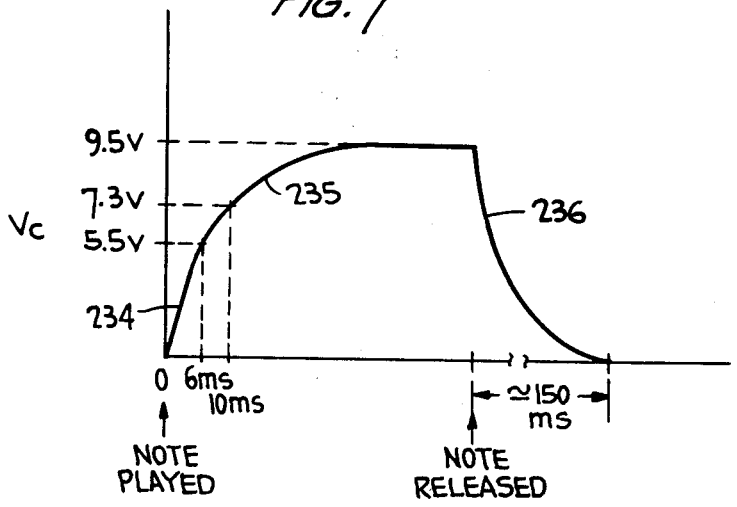
FIG. 7 illustrates a waveform derived in FIG. 6.

Attack rate and release rate simulation are the same for the two brass instruments, whereby envelope shaping circuit 233 can be utilized to control envelope modulation of both of channels 231 and 232. The attack and release voltage waveform applied by circuit 233 to channels 231 and 232 is illustrated in FIG. 7, wherein the output voltage of circuit 233 is illustrated as a function of time. During the first few, approximately six, milliseconds after derivation of the positive going, trailing edge at the collector of transistor 49, the voltage developed by circuit 233 increases at a relatively rapid exponential rate, as indicated by line segment 234. After the 6 millisecond interval has elapsed, the rate of voltage increase of the output of circuit 233 decreases and assumes the exponential relationship indicated by waveform segment 235. Upon release of a note, the waveform derived by circuit 233 decays at a rate indicated by exponential decay wave portion 236.

To enable the wave shape indicated by FIG. 7 to be derived, circuit 233 includes three cascaded NPN transistors 237, 238 and 239 arranged so that the base of each succeeding stage is connected to be driven by the collector of the preceding stage. Transistors 237 and 239 are normally biased to cut off condition, while transistor 238 is normally biased to be conducting.

The base of transistor 237 is d.c. coupled via resistor 241 and terminal 242 to the collector of transistor 49 so that in response to a positive voltage being derived at the collector of transistor 49, transistor 237 is driven from its normally cut off state into a conducting state. The resulting decrease in the voltage at the collector of transistor 237 is coupled to the base of transistor 238, causing the latter transistor to be biased into a cut off state. In response to transistor 238 being cut off, capacitor 243, which in combination with diode 242 shunts the collector-emitter path of transistor 238, is charged by the d.c. power supply voltage connected to terminal 244 via resistor 245 and diode 242. Thereby, the voltage across capacitor 243 increases as indicated by the waveform segment 234.

In response to the voltage across capacitor 243 reaching a predetermined level, the charge rate of the capacitor is decreased since resistor 246 and diode 247 are connected in series from the collector of transistor 238 to a +5 volt d.c. power supply at terminal 248. In response to the voltage across capacitor 243 increasing above the voltage drop of diode 247, to a level of 5.5 volts, the diode is forward biased so that current from terminal 244 is shunted through resistor 246 and the diode to decrease the charging rate of capacitor 243, as indicated by waveform segment 235. Capacitor 243 continues to charge until the voltage across it reaches a predetermined value, such as 9.5 volts, at which time the capacitor is fully charged.

Capacitor 243 remains charged until all of key switches 31 are deactivated, at which time the voltage at the collector of transistor 49, applied by terminal 242 to the base of transistor 237, drops to a zero level, causing transistor 237 to cut off and transistor 238 to be saturated. Saturation of transistor 238 results in a discharge of capacitor 243 through resistor 249 and the saturated collector-emitter path of transistor 238, to provide waveform segment 236. The voltage variations across capacitor 243 are coupled to the base of transistor 239 and thence to the emitter of the transistor which is a driver for channels 231 and 232.

Waveform segments 234 and 235 control the plural sequentially derived fast and slow attack rates for the instruments simulated by channels 231 and 232, while waveform segment 236 simulates the decay rate of the instruments. It has been found that effective simulation of the instruments can be provided by the attack and decay rates described.

Channels 231 and 232 are substantially the same, with the exception of certain components included in the former which may not necessarily be included in the latter. To provide the different simulation efects, however, the circuits have different component values as required. Because the circuits are substantially the same, channel 231 is described to the exclusion of channel 232; the elements which are not in channel 232, but which are in channel 231, are indicated infra.

When the system is activated to provide simulation of trumpet sounds, the base of NPN transistor 251 is connected to be responsive to the square wave signal derived on the 16 foot output lead of frequency divider chain 10, as coupled through capacitor 252 and diode 253 which is forward biased in response to the positive voltage applied to its anode by the d.c. power supply connected to terminal 254 and resistor 255. If no trumpet simulation is desired, transistor 251 is driven into saturation by connecting the d.c. power supply voltage at terminal 212, FIG. 5, through switch 211 and resistor 256 to the transistor base; transistor 251 is prevented from passing a tone signal because it is held in saturation due to base current being supplied from terminal 212 via resistor 256 and switch 211. Switch 211 is the same switch as is illustrated in FIG. 5; it is a single pole, double throw switch arranged so that its contact connects terminal 212 to only one of resistors 210 or 256. Thereby, the trumpet flatting effect is provided only when switch 211 is activated to enable transistor 251 to be responsive to the 16 foot output of frequency divider chain 10.

The square wave tone signal applied to input capacitor 252 results in a pulse waveform at the collector of transistor 251 which is amplitude modulated in response to the voltage supplied to the base of transistor 239. Envelope modulation of the tone signal occurs because the voltage supplied to the collector of transistor 251 is derived from the emitter of transistor 239, having a waveform as shown by FIG. 7, which enables simulation of the plural attack rates indicated by wave segments 234 and 235 and the decay rate indicated by wave segment 236.

The tone signal developed at the collector of transistor 251 is fed via diode 258 to a bandpass filter 259 of the active type. Diode 258 is included to enable the bandpass filter to be decoupled from any voltage variatons which might appear at the collector of transistor 251 when trumpet simulation is not performed.

Bandpass filter 259 is of the active type, including NPN transistor 261 and a feedback circuit from the emitter of the transistor to its base, which is responsive to the signal coupled through diode 258 via capacitor 262. The base of transistor 261 is forward biased by a positive d.c. voltage connected to terminal 263 and resistor 264 to a terminal between filter resistors 265 and capacitor 262. The feedback path from the emitter of transistor 261 and to its base includes capacitor 266 which provides a first shunt path for the transistor emitter base junction, as well as the series combination of resistor 267 and capacitor 268 which provides a second shunt path for the emitter base junction. The connection between resistor 267 and capacitor 268 is shunted to ground by capacitor 269. The signal derived at the output of bandpass filter 259 is developed across emitter load resistor 270. The values of the components included in bandpass filter 259 are selected so that the filter center frequency is approximately at 1200 Hz.

The filtered output signal of bandpass filter 259 is fed to variable wave shaper 273 which controls tone color during the attack phase of the tone signal applied thereto whereby brightness increases as time increases as a voice is being initially sounded. This effect is achieved by varying the non-linear impedance of circuit 273 so that during the attack phase the high frequencies derived from bandpass filter 259 are attenuated as a variable function of time. To these ends, the emitter of transistor 261 is connected to resistor 274, which is connected to ground through a variable non-linear impedance shunt path including capacitor 275 and diode 276.

When no note is being played, diode 276 is forward biased to provide a low impedance shunt path between resistor 274 and ground, whereby the filter attenuates the high frequencies in the tone signals. Diode 276 is forward biased in response to the relatively high voltage at the collector of transistor 237, which is fed to the anode of diode 276 through diode 277 and a bias control network including series resistors 278 and 279, the junction between which is shunted to ground by capacitor 280. Diode 277 is poled in such a manner that capacitor 280 is charged to 0.75 of the voltage at the collector of transistor 237 in response to transistor 237 being biased to its cut off condition, an exists when no note is depressed and for the first 20 milliseconds after depression of a note.

In response to transistor 237 being forward biased 20 milliseconds after initial depression of a key, diode 277 is back biased and capacitor 280 is discharged through diode 276 and resistor 279. As time progresses, the discharge current decreases and the impedance of diode 276 is increased, until the diode is no longer biased to a conducting state. As the impedance of diode 276 increases, the shunt impedance from resistor 274 to ground increases, reducing the attenuation of the high frequencies in the tone signal passed through circuit 273. For a typical circuit simulating the attack action of a trumpet, the variable wave shaping action provided by diode 276 and capacitor 275 is completed in approximately 200 milliseconds. In response to release of all keys a similar variable filtering effect is provided in the opposite direction in response to diode 276 being forward biased in response to the increasing voltage developed across capacitor 280 from the relatively high voltage at the collector of transistor 237.

It has been found that the tone brightening effect provided by the variable impedance connected between resistor 274 and ground is not as important for trombone simulation as for trumpet simulation. Therefore, in channel 232, the tone brightening effect is not necessarily included and the components associated therewith, i.e., capacitors 275 and 280, resistors 278 and 279, and diodes 276 and 277 can be excluded.

Additional tone color filtering, under control of the musician as a function of tone loudness, is provided by variable wave shaper 282 that receives the tone signal derived from tone color control circuit 273. Dynamic wave shaping by 282 is controlled by the musician depressing expression shoe 18. In response to no depression of expression shoe 18, the high frequencies of the tone signal are passed through circuit 282 with substantially attentuation, while minimum attenuation and dynamic wave shaping of the high frequencies are provided by maximum depression of the expression shoe.

To these ends, circuit 282 includes a variable impedance shunt path across the output of circuit 272. The variable impedance shunt path comprises capacitor 283 and diode 284, having its anode connected to capacitor 283 and its cathode grounded. The junction between the diode 284 and capacitor 283 is connected to a variable d.c. voltage at slider 285 of potentiometer 286 via coupling resistor 287. Slider 285 is controlled by depression of expression shoe 18 so that in response to the expression shoe being completely depressed, the slider picks off a very low or zero d.c. voltage, but if the expression shoe is not depressed, a maximum d.c. voltage is fed to diode 284 by slider 285. In response to full depression of expression shoe 18, diode 284 is biased to cut off, whereby a high shunt impedance is provided for the high frequencies of the tone signal and maximum brightness is thereby attained. In contrast, diode 284 is forward biased to a great extent if the expression shoe is not depressed at all, to provide a great deal of attenuation for the high frequencies of the tone signal and reduced brightness. The signal developed across capacitor 283 and diode 284 is fed to the output terminal of channel 231 via a coupling network including series resistor 288 and capacitor 289.

The output of channel 231 is combined with the output signal of channel 232, which provides trombone simulation in response to the 32' tone input, and the attack waveform developed at the emitter of transistor 239, as well as an indication of expression shoe position, as coupled to a potentiometer pick off point within channel 232. The tones derived from channels 231 and 232 are combined in an additive manner to provide complete simulation for the two brass instruments.

FLUTE FILTERS, FIG. 8

Reference is now made to FIG. 8 of the drawing wherein there is illustrated in partially block diagram and partially circuit schematic diagram flute filters 12. There are five separate flute filter channels 201–205, each of which is substantially the same, except for fixed circuit component values associated with different cut off frequencies for the different channels. The five channels 201, 202, 203, 204 and 205 are respectively responsive to the $1\frac{1}{3}'$, $2\frac{2}{3}'$, 4', 8', and 16' square wave tone output signals of frequency divider chain 10. The signals filtered in channels 201 and 202 for the partials $1\frac{1}{3}'$ and $2\frac{2}{3}'$, are combined together in an amplifier 206, the output of which is fed to gate 14. The filtered signals responsive to the 4', 8' and 16' outputs of divider chain 10 are fed by filters 203–205 to amplifier 207, the output of which is fed to gate 15.

Each of filters 201–205 includes a fixed filter section of the low pass type, as well as a variable gain amplifier circuit, the gain of which is directly proportional to the highest pitch indicating voltage on lead 24, as coupled to the filters via terminal 208. By controlling the gain of each of filters 201–205 in response to the highest note depressed key, the amplitude of the fundamental frequency remains relatively constant over the frequency range of the input signal while providing a given attenuation for harmonics associated with the key irrespective of input frequency. Harmonic filtering, to the exclusion of fundamental filtering, enables the filter outputs to resemble, more closely, a sinusoidal wave shape, rather than the square wave shape of the filter input to provide more accurate flute simulation.

To these ends, in one embodiment, channel 201 includes a variable gain amplifier comprising NPN transistors 211, the base of which is responsive to the square wave output of frequency divider chain 10 for the $1\frac{1}{3}'$ tone. The collector of transistor 211 is connected in a d.c. circuit to be biased by the output voltage of sample and hold circuit 8 via resistor 212, while the emitter of the transistor is grounded. As the output voltage of sample and hold circuit 8 increases, the gain of transistor 211 is accordingly increased so that the transistor gain is directly and linearly proportional to the highest pitch signal on lead 24. Therefore, as the highest pitch signal voltage on lead 24 increases, the gain of amplifier 211 increases.

The output signal, at the collector of transistor 211, is coupled to a fixed, low pass filter circuit 213 that may include one or several cascaded resistance capacitance sections. For purposes of the present description, there are illustrated two cascaded sections 214 and 215, having different cut off frequencies such that the cut off frequency of section 214 is less than that of section 215. Thereby, filter circuit 213 provides approximately 6 db attenuation for its input frequencies between the cut off frequencies of sections 214 and 215, about 12 db attenuation for input frequencies greater than both cut off frequencies, and substantially no attenuation for frequencies less than both cut off frequencies.

Channel 201 provides substantial attentuation for harmonics of the $1\frac{1}{3}'$ input signals fed thereto while enabling the fundamental, regardless of frequency, to be passed. Attenuation of harmonics, without fundamental attenuation, is attained because the gain of transistor 211 is directly proportional to the highest pitch signal indicated by the voltage on lead 24. The gain of amplifier 211 and the low pass filter characteristics of filter circuit 213 are such that all fundamentals coupled to channel 201 between the two cut off frequencies of sections 214 and 215 passed through the channel with the same degree of attenuation.

The operation of channel 201 can, perhaps be best described by considering a few examples. Assume that the cut off frequencies of sections 214 and 215 are $f_o$ and $2f_o$, respectively, and that the gains of amplifier 211 are one and two for notes having fundamentals of $f_o$ and $2f_o$, respectively. Under these circumstances filter circuit 213 respectively provides approximately 0 db and 6 db attenuation for $f_o$ and $2f_o$. If the $f_o$ note is the highest frequency struck key, the $f_o$ fundamental is passed with 0 db while its second harmonic, $2f_o$, is attenuated 6 db and its fourth harmonic, $4f_o$, is attenuated 18 db. If the $2f_o$ note is the highest note struct key, the $-6$db of attenuation provided for the $2f_o$ fundamental by filter circuit 213 is compensated by the increased, $+6$ db gain of amplifier 211 so that the $2f_o$ frequency is passed by channel 201 with 0 db, the same as the $f_o$ fundamental when the $f_o$ note was the highest not struck key. The second harmonic, $4f_o$, of the $2f_o$ fundamental is attuanuted 12 db by channel 201.

As an alternate configuration, the range of fundamental frequencies passed without attenuation can be increased while providing the same degree of attenuation for all higher harmonics. In general, this result is attained by cascading several (N) individual, gain controlled amplifier stages, each followed by a low pass filter; each filter may have the same cut off frequency to achieve the same harmonic attenuation slope as a function of frequency. If N stages are provided, the harmonic attenuation rate is 6N db per octave. In one arrangement, such a result can be achieved by connecting a transistor linear amplifier between stages 214 and 215 and controlling the gain of the linear amplifier in the same manner that the gain of transistor 211 is changed. Such a configuration provides two variable gain sections, which have a multiplicative effect on the total filter characteristic. The two variable gain sections, in combination with the two low pass filter sections, provide 0 db attenuation for all fundamental frequencies equal to or greater than the common cut off frequency of the filter sections and 12 db per octave attenuation for all harmonics of the fundamentals.

The same result of 0 db attenuation for the fundamental and 6N db per octave for harmonics can be achieved with N stages having different types of gain controlled elements, as illustrated in FIG. 9 wherein two cascaded stages 221 and 222 are provided. The gain of each of stages 221 and 222 is controlled in response to the highest pitch indicating signal derived from sample and hold circuit 8 as coupled to terminal 208. Stage 221 includes a variable gain amplifier and one low pass filter section, having the same configuration as amplifier 211 and stage 214 of the channel illustrated in FIG. 8. The output of stage 221 is fed through d.c. blocking capacitor 224 and variable impedance diodes 226 and 227 to a low pass filter section comprising series resistance 228 and shunt capacitor 229. Bias voltage is applied to the anodes of diodes 226 and 227 from terminal 208 via resistor 230, and a return path from the cathode of the diodes to ground is provided by resistors 231 and 232. Capacitor 224 is selected to have a large enough value such that all frequencies of interest are passed through it without attenuation. The cut off frequency of the filter including resistor 228 and capacitor 229 can be equal or different from the cut off frequency of the low pass filter included in section 221, depending upon whether it is desirable to attenuate certain harmonics to a greater extent than others.

In response to variations in the d.c. voltage at terminal 208, the impedances of diodes 226 and 227 are varied. As the voltage at terminal 208 increases, the impedance of diodes 226 and 227 decreases, to reduce the attenuation inserted by filter section 222 on its input signal. Since each of sections 221 and 222 includes a variable gain or variable attenuation device having signal passing properties directly proportional to the highest pitch indicating voltage on lead 24, the attenuation characteristics of the two filter sections are overcome for the range of fundamental frequencies.

VOLTAGE CONTROLLED FILTER, FIG. 10

Consideration is now given to the voltage controlled filter 13 responsive to the tone signals selectively derived from waveform shaper 22 in response to the 32', 16' and 8' signal tones supplied to the shaper 22, as well as in response to the noise and key activation tone signals supplied to the shaper 22. Filter 13 enables ususual and variable characteristics to be provided for its input signal. The filter includes means for providing one, or a combination of three, transfer functions that provide low pass, bandpass and high pass filter characteristics on its input signal. The filter characteristics provided by filter 13 are variable with regard to selectively (Q) and cut off or center frequency (which can be considered resonant frequency), depending upon the desires of the musician. The resonant frequencies can be determined in response to one of: the highest pitch indicating voltage derived from sample and hold circuit 8, the position of expression shoe 18, or the attack control provided by the waveform fed by mode selector 19 to gate 15 for controlling the 16', 8' and 4' outputs of the flute filters. Selectivity of the filter characteristics, that is its Q, is controlled by a preset operator adjustment.

To these ends, filter 13 is of the active type, including conventional d.c. operational amplifiers 241, 242, and 243, that include a phase inverting, i.e., negative input, and a non-phase inverting, i.e., positive, input so that the output voltage of each amplifier is proportional to the difference of the voltages at its positive and negative input terminals. Amplifier 241 is responsive to signals at its positive and negative input terminals and is provided with a negative d.c. feedback path comprising resistor 244, whereby the output voltage of amplifier 241 is indicative of the difference between the input signals supplied to its positive and negative input terminals. The non-inverting input terminals of amplifiers 242 and 243 are grounded while the inverting input terminals have tone signals applied, these amplifiers are provided with capacitors 245 and 246 in their negative feedback loops so that the outputs thereof are proportional to the integral of the inputs applied to the inverting input terminals thereof. The output signal of integrator 243 is coupled via a d.c. feedback path including resistor 247 to the negative input terminal of amplifier 241, which is also responsive to the tone indicating output signal of waveform shaper 22, as derived at terminal 164, FIG. 4, and coupled through resistor 248. Connected between the output of amplifier 241 and the negative input terminal of amplifier 242 is two quadrant multiplier 249, responsive to a d.c. voltage at terminal 251. A similar multiplier 252, connected between the output of amplifier 242 and the negative input terminal of amplifier 243, responds to the d.c. voltage at terminal 251. Multipliers 249 and 252 thereby respectively drive output signals of both polarities that are proportional to the products of the voltage at terminal 251 and the output voltages of amplifiers 241 and 242.

The d.c. voltage at terminal 251 determines the filter resonant frequency, i.e., the center frequency of the bandpass filter characteristic, the cut off frequency of the low pass and high pass filter characteristics. The voltage at terminal 251 is controlled by the operator activating one of switches 253, 254 or 255 to selectively couple the highest note indicating d.c. output voltage of sample and hold circuit 8, a d.c. voltage indicating the position of expression shoe 18, or the attack waveform fed to gate 15 by mode selector 19. The expression shoe controls the position of slider 260 of d.c. energized potentiometer 261 such that voltage fed through switch 254 has a maximum value for maximum depression of expression shoe 18; the d.c. voltage has a minimum value in response to the expression shoe being in the up position.

The Q of the filter characteristics is determined by a feedback path between the output of amplifier 242 and the non-inverting input terminal of amplifier 241. The feedback path includes a pair of fixed resistors 256 and 257, between which is connected potentiometer 258, having a slider 259 that is connected via a d.c. path to the non-inverting input terminal of amplifier 241; resistors 256 and 257 and potentiometer 258 provide a shunt path for the output of amplifier 242 to ground. Resistor 257 is provided to limit the gain of the network, whereby the possibility of oscillation at a frequency in the band of interest is obviated. Fixed resistor 256 is provided to enable the desired range of Q values to be obtained.

To derive the high pass, bandpass and low pass filter characteristics, the output signals of amplifiers 241, 242 and 243 are selectively fed through switches 261, 262 and 263, any or all of which may be closed at the will of the operator, depending upon the desired effect, to a common output terminal 264. If more than one of switches 261–263 is activated to the closed state, the voltage derived at terminal 264 provides a combination filtering effect for the tone signal supplied to resistor 248.

It can be shown that the low pass, bandpass and high pass filter transfer functions are respectively represented by:

$$\frac{K}{1 + kd\left(\frac{jw}{aV_{dc}}\right) + \left(\frac{jw}{aV_{dc}}\right)^2} \quad (2)$$

$$\frac{K\left(\frac{jw}{aV_{dc}}\right)}{1 + kd\left(\frac{jw}{aV_{dc}}\right) + \left(\frac{jw}{aV_{dc}}\right)^2} \quad (3)$$

$$\frac{K\left(\frac{jw}{aV_{dc}}\right)^2}{1 + kd\left(\frac{jw}{aV_{dc}}\right) + \left(\frac{jw}{aV_{dc}}\right)^2} \quad (4)$$

where:

$K$ = gain of the filter, determined by impedance compound values;

$k$ = proportionality constant, determined by the relative resistances of resistor 256 and the total resistance of potentiometer 258;

$kd = (1/Q)$ = indication of the position of slider 256;

$j = \sqrt{-1}$ $w$ = frequency $aV_{dc}$ = the circuit resonant frequency;

$V_{dc}$ = d.c. voltage at terminal 251.

From Equations (2), (3) and (4), it is seen that the resonant frequency, $aV_{dc}$, and Q of each of the transfer functions are identical. By increasing the voltage applied to terminal 251, the resonant frequency is increased. The Q is increased by moving slider 251 toward the connection between resistor 257 and potentiometer 258, while decreases in Q are provided by moving the potentiometer toward the connection between resistor 256 and potentiometer 258.

MODULATION OSCILLATOR AND NOISE GENERATOR, FIG. 11

Figure 11:
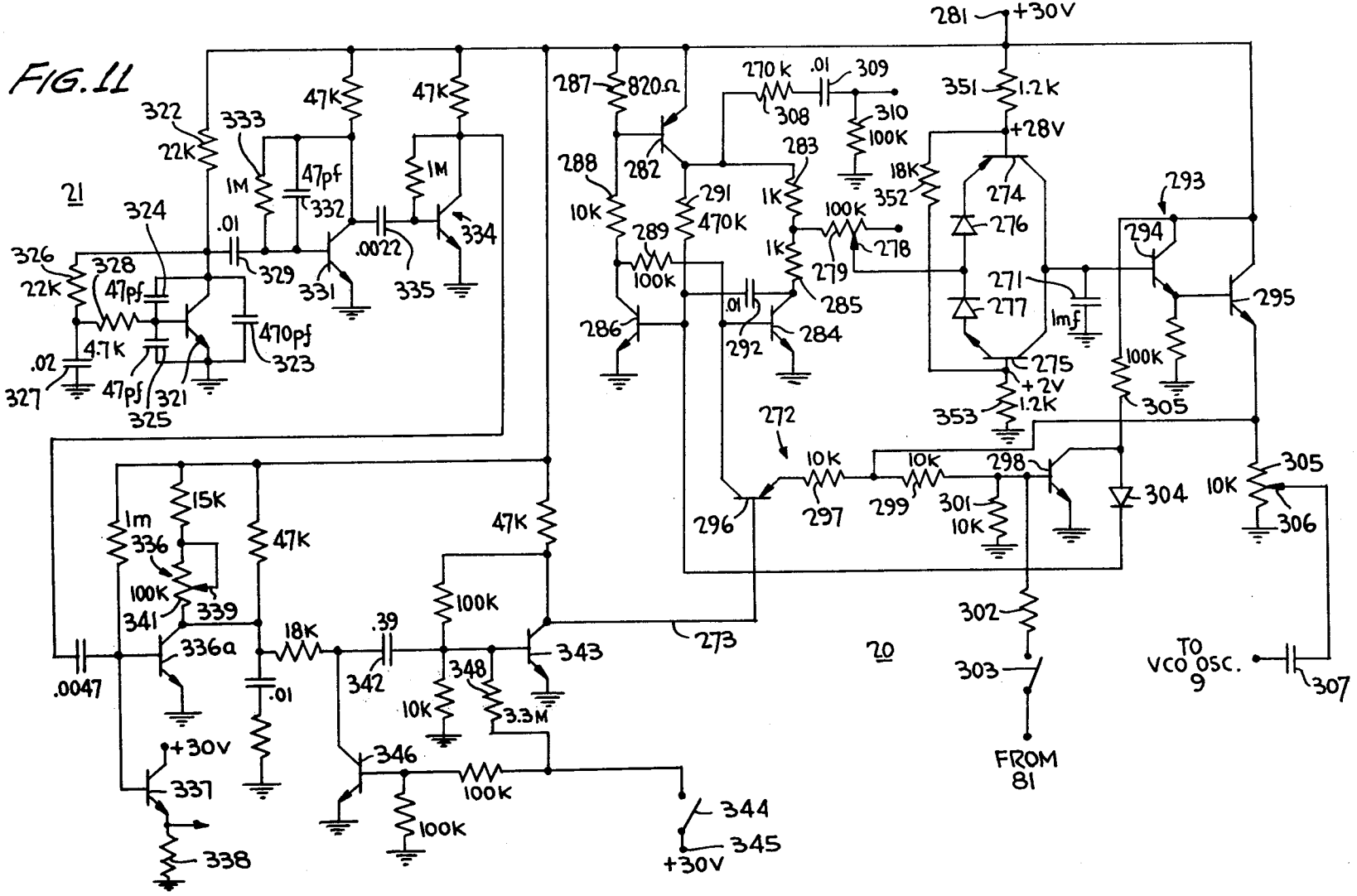
FIG. 11 is a circuit diagram of a vibrato oscillator, noise source and associated circuitry used in FIG. 1.

Reference is now made to FIG. 11 of the drawing wherein there is illustrated a circuit diagram for vibrato oscillator 20, noise generator 21 and control circuitry interconnecting the noise generator and the vibrato oscillator, as well as other control circuitry.

Vibrato is an important sub-audio frequency musical embellishment that adds an artistic sense to music due to deviation of a tone from a precise and steady frequency. It is extremely difficult for a musician playing a flute or a brass instrument to produce a tone of constant frequency. The deviation from the constant frequency is a vibrato effect, which in actuality is a random, sub-audio frequency, variation of tone. It has been found that accurate simulation of the vibrato effect can be achieved by random variation of the tone frequency at a sub-audio modulation frequency that may lie in the region of between approximately 5.5 and 9.5 Hertz. Typically, the random variation is plus or minus 15% about the sub-audio modulation frequency.

In simulating the vibrato effect, the present invention provides a vibrato oscillator of the relaxation type wherein capacitor 271 is supplied with constant charging and discharging current to derive a triangular type waveform. The slopes of the leading and trailing edges of the triangle type waveform are maintained equal because of the equal charging and discharging currents. The durations of the charge and discharge portions of the waveform may be variable by varying the input voltage level on lead 273 of comparison trigger circuit 272 that also responds to the capacitor voltage. For the random vibrato effect, the trigger level on lead 273 is responsive to the output of noise generator 21. If random control of the vibrato frequency is not desired, a constant input voltage is supplied to comparison trigger 272 by lead 273, whereby charging and discharging currents are supplied to capacitor 271 for non-random time durations.

To establish the constant charge and discharge currents for capacitor 271, PNP and NPN transistors 274 and 275 are provided. Transistors 274 and 275 are biased by a resistive voltage divider including resistors 351–353 that are connected between the positive d.c. power supply voltage between terminal 281 and ground. Taps of the voltage divider are connected to bases of transistors 274 and 275 to provide base biases of +28 volts and +2 volts, respectively. The emitter collector paths of transistors 274 and 275 are individually series connected with capacitor 271, with the emitter of transistor 274 being connected to the cathode of diode 276, while the emitter of transistor 275 is connected to the anode of diode 277. The cathode and anode of diodes 277 and 276 have a common terminal, which is connected to tap 278 of variable resistor 279. The setting of tap 278 is set by the musician to control the charging and discharging current levels supplied to capacitor 271, and therefore the basic oscillation frequency of the vibrato oscillator. When capacitor 271 is being charged, the d.c. supply voltage at terminal 281 supplies positive d.c. current through the emitter collector path of transistor 282 and coupling resistor 283, connected to one end of resistor 279, and thence through diode 276 and the emitter collector path of transistor 274 to the capacitor. During discharge of capacitor 271, the emitter collector path of PNP transistor 282 is turned off, while the emitter collector path of transistor 284, which was turned off while the emitter collector path of transistor 282 is turned on, is turned on. Thereby, a discharge path is provided from capacitor 271 through the emitter collector path of transistor 275, diode 277, resistor 279, coupling resistor 285 and the emitter collector path of transistor 284 to ground.

PNP transistor 282 and NPN transistors 284, and 286 are interconnected with each other in a flip-flop type circuit such that the emitter collector path of transistor 286 is in a conducting state while transistors 282 and 284 are respectively activated to the conducting and non-conducting state; the emitter collector path of transistor 286 is cut off while the emitter collector paths of transistor 282 and 284 are respectively cut off and conducting. To these ends, the base of transistor 282 and collector of transistor 286 are connected to be biased by the positive d.c. supply voltage at terminal 281 via resistors 287 and 288 and base bias for transistor 284 is provided through resistor 289 that is connected to the terminal common to resistor 288 and the collector of transistor 286. The base of transistor 286 and collector of transistor 282 are interconnected by resistor 291. To positively establish the flip-flop type action, the collector of transistor 284 is connected to the base of transistor 286 and the collector of transistor 282 via capacitor 292. The charging circuit for capacitor 292 has component values such that it normally has no effect on the frequency of oscillations derived by the vibrato oscillator.

The frequency of the vibrato oscillator is controlled by comparing the voltage across capacitor 271 with the input voltage supplied by lead 273 to comparator trigger network 272. The voltage variations of capacitor 271 are coupled to an isolation amplifier 293 that includes cascaded emitter follower stages 294 and 295; the base of emitter follower 294 is responsive to the voltage across capacitor 271. The impedance seen by capacitor 271 between the base of transistor 294 and ground remains constant, despite variations in the capacitor voltage, whereby the constant charging and discharging currents supplied to capacitor 271 by transistors 274 and 275 result in linear increases and decreases of the capacitor voltage, which are derived at the emitter of transistor 295.

The voltage amplitude derived by amplifier 293 controls when transistors 282 and 284 are activated into the conducting and non-conducting states. To these ends, the voltage at the emitter of transistor 295, an in phase replica of the voltage variations of capacitor 271, is fed via resistor 297 to the emitter of transistor 296 that is included in comparison trigger network 272. The base of transistor 296 responds to the voltage on lead 273, which can be constant or randomly variable depending upon whether the musician selects the reiterative or random mode of operation. In response to the voltage at the emitter of transistor 295 exceeding the voltage between the base and emitter of transistor 296, the transistor 296 is activated into a conducting state and positive current is supplied to the base of transistor 284, to drive that transistor into a conducting state, whereby transistor 282 is cut off and capacitor 271 begins to discharge through the constant current drain comprising transistor 275, diode 277, resistor 279 and transistor 284. As capacitor 271 begins to discharge, the voltage at the emitter of transistor 295 decreases, causing the emitter base junction of transistor 296 to become back biased, whereby the collector of transistor 296 does not supply current to the base of transistor 284. Transistor 284, however, remains conductive because of the bias applied to its base by resistors 287–289.

The discharge current of capacitor 271 continues through the emitter collector path of transistor 284 until NPN transistor 298 in comparator trigger 272 is driven out of saturation in response to a predetermined low voltage level at the emitter of transistor 295 which is coupled to the base of transistor 298 via coupling resistor 299. In the random mode, the base of transistor 298 is responsive solely to the voltage at the emitter of transistor 295, as fed to its base emitter bias resistor 301 by resistor 299. In the reiterative mode, however, a certain amount of forward bias is applied to the base of transistor 298 whenever a key 31 is not depressed by virtue of the connection of the collector of transistor 81, FIG. 2, to the base of transistor 298 through resistor 302 and switch 302 which is closed only while the organ is in the reiterative mode and prevents the oscillator from oscillating. With the system in the reiterative mode, a constant voltage level is applied to lead 273, as described infra, and when any of keys 31 are depressed transistor 81 saturates, which removes the forward bias provided to transistor 298, resulting in a fixed oscillation frequency. Thus the oscillator is synchronized each time a voltage appears on lead 24 in response to key activation.

In either mode, in response to the voltage at the emitter of transistor 295 being greater than the predetermined level, even though the voltage of capacitor 271 is decreasing, the emitter collector path of transistor 298 is forward biased to saturation, whereby the transistor collector is at a sufficiently low voltage to prevent coupling of the d.c. voltage at terminal 281 through diode 304, the anode of which is connected to a junction between the collector of transistor 298 and one terminal of resistor 305, the other terminal of which is connected to the voltage at terminal 281. In response to transistor 298 being driven out of saturation and into cutoff because the voltage at the emitter of transistor 295 has reached the predetermined level, positive voltage is fed from terminal 281 through resistor 305 and diode 304 to the base of transistor 286 and the collector of transistor 284, the latter being via capacitor 292. In response to the positive voltage fed through diode 304, transistor 286 is activated to the conducting state and transistor 284 is driven to cutoff. The conducting state of transistor 286 produced sufficient voltage drop across resistor 287 to cause PNP transistor 282 to be driven into a conducting state.

Two output signals are derived from the oscillator illustrated in FIG. 11; one output is utilized to control the frequency of voltage controlled oscillator 9, and the second output provides gating voltages to mode selector 19. The frequency of voltage controlled oscillator 9 is responsive to the basically triangular voltage variations of capacitor 271, as derived at the emitter of transistor 295 and coupled to potentiometer 305. Slider 306 of potentiometer 305 is positioned to control the magnitude of the voltage variations supplied by the vibrato oscillator to voltage controlled oscillator 9, and thereby determines the modulation index imposed by the vibrato oscillator on the frequency of the voltage controlled oscillator. Slider 306 is connected via coupling capacitor 307 to terminal 203 of the vibrato oscillator illustrated in FIG. 5. The reiterative output is in the form of pulses which are derived every cycle by a differentiating network including series resistor 308, capacitor 309 and shunt resistor 310, that is responsive to the basically square wave voltage variations at the collector of transistor 282. The voltage developed across resistor 310 is connected to the base of transistor 102, FIG. 3, in response to switch 123 being activated to the closed condition during the reiterative mode, whereby transistor 102 is driven into a conducting state once every cycle of the modulator by the positive going pulses developed across resistor 310.

In response to variations in the voltage on lead 273 due to noise from noise generator 21, the emitter base forward bias point of transistor 296 is controlled. If the voltage on lead 273 is maintained constant, the charging and discharging times of capacitor 27 are equal, as illustrated in FIG. 12A, which represents the square wave voltage variations between the emitter and collector of transistor 284. The voltage variations of capacitor 271 are illustrated in FIG. 12B wherein the linear charge and discharge currents are reflected in the identical leading and trailing slopes of the triangular waveform. The peak upper and lower values of the triangle waveform are to be noted. In contrast, in FIG. 13, which illustrates waveforms derived in response to random noise variations on lead 273, the peak voltages of the triangular waveform are variable, being dependent upon the amplitude of the noise signal on lead 273, as indicated by waveform 314; the triangular voltage variations 313 have linear, equal slopes because of the equal charge and discharge currents. The noise signal derived on lead 273 has a variable level, controlled by the musician, and a white noise characteristic over a frequency range between approximately 50 Hz. and 15 to 20 KHz.

The white noise generator 21 comprises an NPN transistor 321 having its emitter collector path biased by the positive voltage at terminal 281, as coupled through resistor 322. Thermal noise of transistor 321 is generated by connecting capacitors 323-325 between its collector and emitter, base and emitter and collector and base. Base bias is provided by series resistors 326 and 328. The thermal noise voltage variations derived at the collector of transistor 321 are a.c. coupled via capacitor 329 to the base of NPN transistor 331 which includes a feedback circuit comprising capacitor 332 and resistor 333, designed to attenuate some of the high frequency noise variations.

The noise signal developed at the collector of transistor 331 is fed via coupling capacitor 335 to a high gain, clipping amplifier comprising cascaded fixed gain transistor amplifier stage 334 and variable gain stage 336, both of which are connected in the grounded emitter configuration. The signal at the collector of transistor 334 is also supplied to the base of emitter follower transistor 337. Voltage developed across emitter load resistor 338 of emitter follower 337 is selectively fed to the base of transistor 185, FIG. 4, via capacitor 186 to enable simulation of wind, surf, and associated noise type signals in waveform shaper 22, as described supra.

The gain of amplifier 336 is controlled by the position of slider 339 of variable resistor 341, connected in the collector bias circuit of transistor 336*a*. The position of slider 339 is selected in accordance with the desired amount of the random frequency variations of vibrato oscillator 20; the gain is directly proportional to the frequency variation desired. The noise signal derived at the collector of transistor 336*a*, which has a clipped waveform so that it consists of two voltage levels having randomly varying leading and trailing edges, is a.c. coupled via capacitor 342 to a further amplifier stage 343, the output of which is d.c. coupled to the base of transistor 296 via lead 273. The d.c. level at the collector of transistor 343, supplied to lead 273, is such that the noise signal varies about an average value to maintain the vibrato center frequency, about which the frequency variations occur, at the fixed level determined by the setting of resistor 279.

If it is desired to defeat the random variations in the frequency of the vibrato oscillator, as during the reiterative mode, the collector output of amplifier 336 can be selectively shunted to ground, whereby a constant voltage is applied by transistor 343 to the base of transistor 296 via lead 273. To these ends, switch 344 selectively connects a positive d.c. voltage at terminal 345 to the bases of NPN transistors 343 and 346. The base bias applied to transistor 346 when switch 344 is closed is sufficient to drive transistor 346 into saturation, to prevent coupling of the noise signal to the base of transistor 343. The base of transistor 343 is biased by its connection through resistor 348 and switch 344 to the positive d.c. voltage at terminal 345 such that the same d.c. value is derived at its output as is derived when the noise signal is fed thereto.

While there has been described and illustrated one specific embodiment of the invention, it will be clear that variations in the details of the embodiment specifically illustrated and described may be made without departing from the true spirit and scope of the invention as defined in the appended claims.

What I claim is:

1. In an electronic organ, an improvement comprising:

means for generating a repetitive pulse tone signal;

a source of control voltage, the magnitude of said control voltage being dependent upon selected notes played on a keyboard of the organ;

means responsive to the magnitude of said control voltage for modulating the widths of said pulses as a function of said magnitude of said control voltage.

2. An improvement, according to claim 1, wherein further is provided means responsive to said control voltage for controlling the frequency of said repetitive pulse tone signals as a function of said magnitude.

3. An improvement, according to claim 1, wherein said means for modulating the widths of said pulses is arranged to decrease the width of said pulses as the frequency of said pulses increases.

4. An electronic organ comprising:

a source of tone signals;

an acoustic radiating system;

a key;

electronic keying means responsive to actuation of said key for transferring said tone signals to said acoustic radiating system; and means included in said electronic keying means for introducing consecutive first and second rates of rise of said tone signals during an attack phase by introducing diverse rates of charging of a charging capacitor during the attack phase.

5. An electronic organ comprising:

a source of tone signals for producing tone signals having a first harmonic and higher harmonics;

an acoustic radiating system;

a key;

means responsive to actuation of said key for applying said tone signals to said acoustic radiating system such that said tone signals have an attack phase; and means for increasing the brightness of said tone signals during said attack phase by progressively decreasing the attenuation of the higher harmonics.

6. An electronic organ comprising:

a source of tone signals for producing tone signals having a fundamental frequency;

an acoustic radiating system;

a key;

means responsive to actuation of said key for applying said tone signals to said acoustic radiating system; and means responsive to initiation of actuation of said key for automatically transiently reducing the fundamental frequency of said tone signals.

7. An electronic organ comprising:

a source of tone signals;

an acoustic radiating system;

a key;

means responsive to actuation of said key for applying said tone signals to said acoustic radiating system; and means for randomly vibrato modulating said tone signals, said last means including:

a source of periodic triangular waves of constant successively positive and negative slopes;

a source of random signal; and means responsive to said random signal for modulating the peak levels of said triangular waves to provide a vibrato modulating signal for said tone signals.

8. An electronic organ comprising:

a series of actuateable keys;

a voltage controlled tone signal oscillator;

means for generating a control voltage for said oscillator having an amplitude which is a function of the identity of an actuated key, said oscillator being responsive to said control voltage for providing tone signals of diverse frequencies as a function of amplitude of said control voltage;

means responsive to the output of said oscillator for providing periodic rectangular tone signals having a first harmonic and higher harmonics;

a low pass filter which progressively attenuates the higher harmonics of said rectangular tone signals more than it attenuates the first harmonic;

a gain controllable amplifier in cascade with said low pass filter; and means responsive to said control voltage for increasing the gain of said amplifier as a function of frequency to compensate for the increasing attenuation of the first harmonic by said low pass filter.

9. An electronic organ comprising:

a source of tone signals;

means connected to said source of tone signals for converting said tone signals selectively to any of (1) a sawtooth wave form tone signal (2) a pulse tone signal (3) a square wave tone signal;

a voltage controlled filter connected in cascade with said means for converting, said filter having selectively low pass, high pass and band pass characteristics;

a source of control voltage, said voltage controlled filter including means responsive to said control voltage for controlling the resonant frequency of said voltage controlled filter.

10. An electronic organ comprising:

a keyboard having plural keys corresponding respectively to diverse pitches;

a tone signal source which generates a tone signal having a complex frequency spectrum;

means responsive to actuation of plural ones of said keys for controlling the frequency of said tone signal source, said means being such that said frequency corresponds with that one of said keys corresponding with the actuated key of highest pitch;

an acoustic radiating system; and means for delaying provision of said tone signal to said acoustic radiating system for a time elapse of at least 10 milliseconds following actuation or release of said actuated key of highest pitch.

11. An electronic musical instrument comprising:

an array of keys;

means responsive to selective actuation of plural ones of said keys for deriving a control voltage having a value which is a function of only the highest note nomenclature of any actuated ones of said keys;

oscillator means responsive to said control voltage for generating a first tone signal of complex wave form corresponding to said highest note nomenclature of any actuated ones of said keys in any of plural footages;

means responsive to initial actuation of said actuated keys as a function of the magnitude of said control voltage for transiently reducing the frequencies of said first signal to an extent and for a duration selected to simulate the sound which various musical instruments make on initiation of said first tone signal of said highest note nomenclature;

means responsive to actuation of all said plural ones of said keys for providing second tone signals corresponding to each of said actuated keys respectively; and means responsive to said first tone signal and to said second tone signals for acoustically transducing said first signal and said second tone signals.

12. An electronic musical instrument, according to claim 11, wherein said various musical instruments are brass instruments.

13. An electronic musical instrument, according to claim 12, wherein said brass instruments may be selectively a trumpet or a trombone, and selection means are provided for adjusting the extent of said reducing of the frequency of said first tone signal according to whether a trumpet or a trombone is to be simulated.

14. An electronic organ comprising:

plural keys each corresponding with a different pitch;

a voltage controlled tone signal oscillator;

means responsive to actuation of plural ones of said keys for providing first tone signals corresponding with each of said plural ones of said keys, respectively;

means for deriving a control voltage in response to actuation of said plural ones of said keys;

means for applying said control voltage to said voltage controlled tone signal oscillator for controlling the frequency of said oscillator, said means for deriving a control voltage being such that said control voltage has a value which is a function of one the highest pitched one of said plural keys being actuated:

means for delaying the application of said control voltage to said oscillator for a time interval of at least 10 milliseconds following actuation or release of one or more of said keys;

means for deriving from said oscillator a plurality of second tone signals of diverse footages;

means for diversely, musically processing each of said plurality of second tone signals of diverse footages as a function of said footages to obtain diverse musical effect; and means for electroacoustically transducing said first tone signals and said second tone signals.

15. An electronic organ, according to claim 14, wherein said means for musically processing includes means for introducing a transient drop of pitch on initiation of said second tone signals, said transient drop of pitch having an extent and a duration selected to simulate the sound which a wind instrument makes.

16. An electronic organ, according to claim 15, wherein said means for musically processing includes means for controlling said transient drops of pitch according to the tonal characteristics of said wind instruments when the latter are played.

17. An electronic organ, according to claim 16, wherein said means for musically processing further includes means for controlling the brightness of said second tone signals as a function of amplitude of said second tone signals according to the types of said wind instruments.

18. An electronic organ, according to claim 16, wherein said means for musically processing further includes means for controlling the brightness of said second tone signals as a function of time according to the types of said wind instruments.

19. An electronic organ, according to claim 17, wherein said means for musically processing includes means for controlling the brightness of said second tone signals as a function of time so as to simulate the sounds of said wind instruments.

20. An electronic organ, according to claim 15, wherein said means for musically processing includes means for randomly vibrato modulating said second tone signals.

21. An electronic organ, according to claim 15, wherein said means for musically processing includes modulating means for vibrato modulating said second tone signals with a triangular wave vibrato signal.

22. An electronic organ, according to claim 21, wherein said modulating means includes:

means for providing a repetitive triangular voltage wave;

means for randomly varying the peak amplitudes of said triangular voltage wave form to provide a vibrato signal; and means for frequency modulating said second tone signals in response to said vibrato signal.

23. An electronic organ comprising:

a keyboard including a set of keys;

a set of tone signal sources for providing first tone signals corresponding one for one with actuated ones of said keys;

a voicing system;

means responsive to actuation of any plurality of said keys for transferring corresponding ones of said first tone signals to said voicing system;

an electroacoustic transducer responsive to voiced signals derived from said voicing system;

an amplifier connected between said voicing system and said electroacoustic transducer;

a pedal controlled gain control circuit connected to said amplifier, said gain control circuit providing a gain control voltage as a function of extent of actuation of said pedal;

means responsive to concurrent actuated conditions of plural ones of said keys for generating only a signal control voltage corresponding to the highest pitch actuated key;

a voltage controlled oscillator responsive to said control voltage;

a time delay circuit interposed between said source of control voltage and said voltage controlled oscillator, said time delay circuit introducing a delay of the order of 20 milliseconds; and means coupling said voltage controlled oscillator to said transducer.

24. An electronic organ, according to claim 23, wherein further is provided:

means responsive to the output of said voltage controlled oscillator for providing an array of second tone signals of diverse footages;

diverse preset voice filters responsive to predetermined ones of said second tone signals of diverse footages; and flute filters responsive to predetermined ones of said second tone signals of diverse footages.

25. An electronic organ, according to claim 24, wherein further provided is a wave shaper responsive to predetermined ones of said second tone signals of diverse footages, said predetermined ones of said second tone signals being square wave tone signals, said wave shaper including means for converting the shapes of said square wave tone signals to tone signals of diverse shapes different from square wave shapes.

* * * * *

UNITED STATES PATENT OFFICE
CERTIFICATE OF CORRECTION

Patent No. 4,056,996 Dated November 8, 1977

Inventor(s) DAVID A. BUNGER

It is certified that error appears in the above-identified patent and that said Letters Patent are hereby corrected as shown below:

Column 3, line 47, insert -- , -- after "grouping";

Column 3, line 53, insert -- , -- after "provided";

Column 3, line 54, insert -- , -- after "musician";

Column 5, line 38, "16', 8', 2 2/3' and 1 1/3'" should be -- 16', 8', 4', 2 2/3' and 1 1/3' --;

Column 6, line 67, "vibrator" should be -- vibrato --'

Column 7, line 57, "controlled as" should be -- controlled as a --;

Column 7, line 60, "12" should be -- 13 --;

Column 12, line 38, "anc" should be -- and --;

Column 14, line 6, "opening of closing" should be -- opening or closing --;

CERTIFICATE OF CORRECTION

Patent No. 4,056,996 Dated November 8, 1977

Inventor(s) DAVID A. BUNGER

It is certified that error appears in the above-identified patent and that said Letters Patent are hereby corrected as shown below:

Column 14, line 34, "8, foot" should be -- 8 foot --;

Column 15, line 35, "stage" should be -- state --;

Column 15, line 38, "lever" should be -- level --;

Column 16, line 8, "which of the footage" should be -- which of footage --;

Column 17, line 11, "174" should be -- 164 --;

Column 19, line 37, "ptich" should be -- pitch --;

Column 22, line 21, "an" should be -- as --;

Column 22, line 63, "272" should be -- 273 --;

Column 26, line 27, "drive" should be -- derive --;

Column 27, line 25, "256" should be -- 258 --;

Column 28, line 44, delte "," after "284";

Column 28, line 50-51, "transis-tor" should be -- transis-tors --;

UNITED STATES PATENT OFFICE

CERTIFICATE OF CORRECTION

Patent No. 4,056,996 Dated November 8, 1977

Inventor(s) DAVID A. BUNGER

It is certified that error appears in the above-identified patent and that said Letters Patent are hereby corrected as shown below:

Column 29, line 54, "switch 302" should be -- switch 303 --;

Column 30, line 50, "27" should be -- 271 --.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*